US011511272B2

(12) United States Patent
Hama et al.

(10) Patent No.: US 11,511,272 B2
(45) Date of Patent: Nov. 29, 2022

(54) TEST CONTAINER FOR EXAMINATION

(71) Applicant: FUJIFILM Corporation, Tokyo (JP)

(72) Inventors: Takeshi Hama, Ashigarakami-gun (JP); Noboru Komori, Ashigarakami-gun (JP); Yuki Inoue, Ashigarakami-gun (JP); Aya Ouchi, Ashigarakami-gun (JP)

(73) Assignee: FUJIFILM Corporation, Tokyo (JP)

( * ) Notice: Subject to any disclaimer, the term of this patent is extended or adjusted under 35 U.S.C. 154(b) by 252 days.

(21) Appl. No.: 16/952,198

(22) Filed: Nov. 19, 2020

(65) Prior Publication Data

US 2021/0170392 A1 Jun. 10, 2021

(30) Foreign Application Priority Data

Dec. 9, 2019 (JP) ..... JP2019-222328

(51) Int. Cl.
*B01L 3/00* (2006.01)

(52) U.S. Cl.
CPC ..... *B01L 3/502* (2013.01); *B01L 2200/0621* (2013.01); *B01L 2200/16* (2013.01); *B01L 2300/0861* (2013.01)

(58) Field of Classification Search
CPC ..... B01L 2200/0621; B01L 2200/0631; B01L 2200/16; B01L 2300/0861;
(Continued)

(56) References Cited

U.S. PATENT DOCUMENTS

2007/0082331 A1 4/2007 Tanaami et al.
2014/0356874 A1* 12/2014 Bearinger ..... B01L 7/00 435/6.12

FOREIGN PATENT DOCUMENTS

JP 2003-166910 A 6/2003
JP 2007-101428 A 4/2007

OTHER PUBLICATIONS

Yan et al ("Multiplex detection of bacteria on an integrated centrifugal disk using bead-beating lysis and loop-mediated amplification "). Sci Rep 7, 1460 (Year: 2017).*

* cited by examiner

*Primary Examiner* — Jennifer Wecker
*Assistant Examiner* — Jonathan Bortoli
(74) *Attorney, Agent, or Firm* — Birch, Stewart, Kolasch & Birch, LLP

(57) ABSTRACT

A test container includes a container main body including a first-accommodation-portion, a second-accommodation-portion, and a third-accommodation-portion each accommodating a liquid and internally provided, a first flow path connecting the first-accommodation-portion and the second-accommodation-portion to each other at respective upper end positions thereof and internally provided, and a second flow path connecting the second-accommodation-portion and the third-accommodation-portion to each other at respective upper end positions thereof and internally provided, in which at least a portion forming an upper wall surface of the second-accommodation-portion has flexibility to be deformable inwards of the second-accommodation-portion; and a liquid return prevention structure which prevents a backflow of the liquid to the first-accommodation-portion, when the liquid accommodated in the second-accommodation-portion is fed to the third-accommodation-portion via the second flow path due to deformation of the portion forming the upper wall surface of the second-accommodation-portion inwards of the second-accommodation-portion.

20 Claims, 19 Drawing Sheets

(58) Field of Classification Search
CPC ..... B01L 2300/161; B01L 2400/0481; B01L 2400/0688; B01L 3/502; B01L 3/50273
See application file for complete search history.

TEST CONTAINER FOR EXAMINATION

CROSS-REFERENCE TO RELATED APPLICATIONS

The present application claims priority under 35 U.S.C. § 119 to Japanese Patent Application No. 2019-222328 filed on Dec. 9, 2019. Each of the above application is hereby expressly incorporated by reference, in its entirety, into the present application.

BACKGROUND OF THE INVENTION

1. Field of the Invention

The technology of the present disclosure relates to a test container.

2. Description of the Related Art

Test containers such as a test cartridge, an analysis chip, and the like used for performing various analysis with respect to a specimen extracted from a biological sample are known.

JP2007-101428A discloses a cartridge for a chemical treatment comprising a plurality of wells (liquid accommodation portions) accommodating a liquid and configured by stacking an elastic member comprising a plurality of recesses on one surface on a substrate so that the recesses face the substrate side, and a flow path connecting between the wells. JP2007-101428A discloses a method for rotating a roller while pressing the elastic member of a cartridge for elastic deformation of the elastic member, to cause pressing of a liquid in the elastically deformed well to move to an adjacent well via the flow path connected to the well.

JP2003-166910A discloses a liquid feeding mechanism which feeds a liquid filled in a liquid tank to a flow path connected to the liquid tank by changing a volume of the liquid tank (liquid accommodation portion) formed to surround a wall, and an analysis device comprising the liquid feeding mechanism.

SUMMARY OF THE INVENTION

For example, as a test container for performing nucleic acid extraction and analysis, it is necessary to provide a test container comprising at least three accommodation portions from an upstream side to a downstream side in a liquid feeding direction, in which the liquid is fed so that a liquid return to the upstream accommodation portion does not occur, in a case where the liquid is fed from the accommodation portion in the middle of the three accommodation portions to the downstream accommodation portion side.

In JP2007-101428A, the liquid is fed to the downstream side in a state where the upstream side is crushed with respect to the accommodation portion containing the liquid and the flow path is blocked, and accordingly, the liquid return to the upstream side does not occur. However, in JP2007-101428A, it is premised that all the liquid accommodated in the upstream accommodation portion is moved to the downstream side. Accordingly, the aspect of proceeding to the next step while remaining the liquid in the upstream accommodation portion cannot be applied. Meanwhile, JP2003-166910A discloses only liquid feeding between two accommodation portions, and a method for preferentially feeding a liquid to the downstream side from an accommodation portion, of which flow paths are connected to both the upstream side and the downstream side is not considered.

In addition, in the test container disclosed in both JP2007-101428A and JP2003-166910A, the flow path connecting the liquid accommodation portions is disposed to connect lower ends of the liquid accommodation portions, and accordingly, even in a case where an external force is not applied, the liquid may pass the flow path and flow into the adjacent accommodation portion due to a capillary force or the like.

The technology of the present disclosure is made in view of the above circumstance, and an object thereof is to provide a test container, comprising at least three accommodation portions accommodating a liquid, and capable of preventing a liquid return to an upstream accommodation portion, in a case where the liquid accommodated in a middle accommodation portion of the three accommodation portions is fed to a downstream accommodation portion.

There is provided a test container, comprising: a container main body including a first accommodation portion, a second accommodation portion, and a third accommodation portion each accommodating a liquid and internally provided, a first flow path connecting the first accommodation portion and the second accommodation portion to each other at respective upper end positions thereof and internally provided, and a second flow path connecting the second accommodation portion and the third accommodation portion to each other at respective upper end positions thereof and internally provided, in which at least a portion forming an upper wall surface of the second accommodation portion has flexibility to be deformable inwards of the second accommodation portion; and a liquid return prevention structure which prevents a backflow of the liquid to the first accommodation portion, when the liquid accommodated in the second accommodation portion is fed to the third accommodation portion via the second flow path due to deformation of the portion forming the upper wall surface of the second accommodation portion inwards of the second accommodation portion.

In the test container of the present disclosure, the container main body may comprise a main body portion in which a portion forming each of the first accommodation portion, the first flow path, the second accommodation portion, the second flow path, and the third accommodation portion is open, and an upper lid member including the portion forming the upper wall surface of the second accommodation portion, and the first accommodation portion, the first flow path, the second accommodation portion, the second flow path, and the third accommodation portion may be internally formed by covering the opening of the main body portion with the upper lid member.

In the test container according to the present disclosure, the liquid return prevention structure preferably has a structure in which a height from an inner bottom surface of the second accommodation portion to an inner bottom surface of the first flow path is higher than a height from the inner bottom surface of the second accommodation portion to an inner bottom surface of the second flow path.

In the test container according to the present disclosure, in a case where the liquid return prevention structure has the structure in which the height from the inner bottom surface of the second accommodation portion to the inner bottom surface of the first flow path is higher than the height from the inner bottom surface of the second accommodation portion to the inner bottom surface of the second flow path, an angle formed by the inner bottom surface of the first flow path and an inner side surface of the second accommodation portion in a level difference portion between the inner bottom surface of the first flow path and the second accommodation portion preferably is an acute angle.

In the test container of the present disclosure, the liquid return prevention structure preferably has a structure of the first flow path and the second flow path in which a water contact angle of an inner surface of the first flow path is set to be greater than a water contact angle of an inner surface of the second flow path.

In the test container of the present disclosure, the liquid return prevention structure preferably has a structure of a stepped portion which is provided on the second accommodation portion side of the first flow path and which includes two or more steps from an inner bottom surface of the second accommodation portion.

In the test container of the present disclosure, in a case where the liquid return prevention structure has the structure of the stepped portion, the angle formed by an inner bottom surface and an inner side surface forming at least one step of the stepped portion is preferably an acute angle.

The test container of the present disclosure may further include a chromatographic carrier for performing a nucleic acid test, and a carrier accommodation portion accommodating the chromatographic carrier.

In the test container of the present disclosure, the first accommodation portion may accommodate a first liquid containing magnetic particles, the first flow path may allow separated magnetic particles separated from the first liquid to pass through the first flow path, and the second accommodation portion may accommodate the separated magnetic particles.

According to the technology of the present disclosure, in the test container comprising at least three accommodation portions accommodating a liquid, it is possible to prevent a liquid return to an upstream accommodation portion, in a case where the liquid accommodated in a middle accommodation portion of the three accommodation portions is fed to a downstream accommodation portion.

DESCRIPTION OF THE PREFERRED EMBODIMENTS

Figure 1:
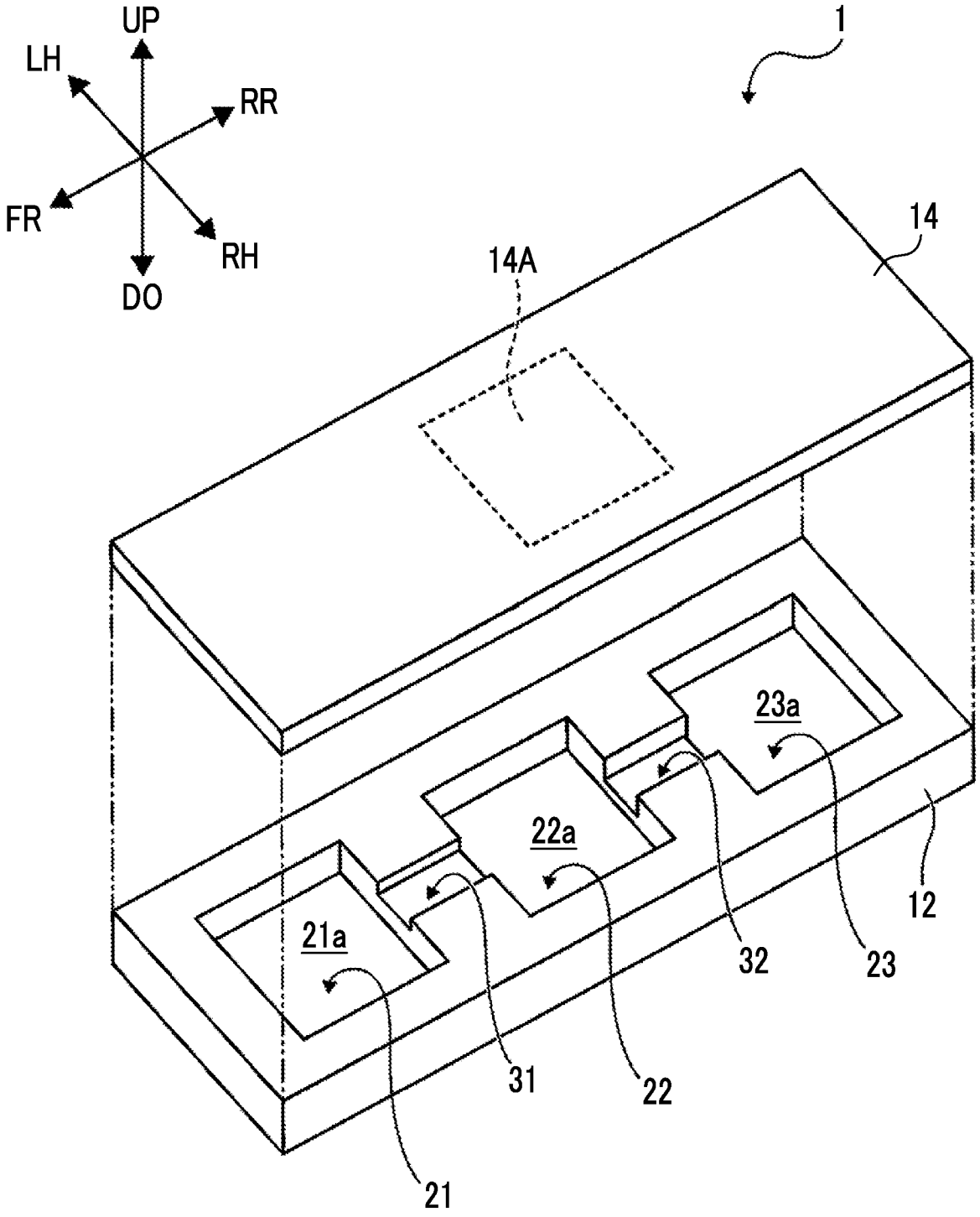
FIG. 1 is an exploded perspective view showing a schematic configuration of a test container 1.

Hereinafter, an example of an embodiment according to the present invention will be described with reference to the drawings. A front direction, a rear direction, an upward direction, a downward direction, a left direction, and a right direction used in the description below correspond to "FR", "RR", "UP", "DO", "LH", and "RH", respectively, in the each drawing. Since these directions are defined for convenience of description, a device configuration is not limited to these directions. The FR side is an upstream side and the RR side is a downstream side in the use of a container. In addition, the scales and the like of the respective constituent elements in the drawings are suitably changed from the actual scales for the sake of easy visual recognition.

Test Container of First Embodiment

Figure 2:
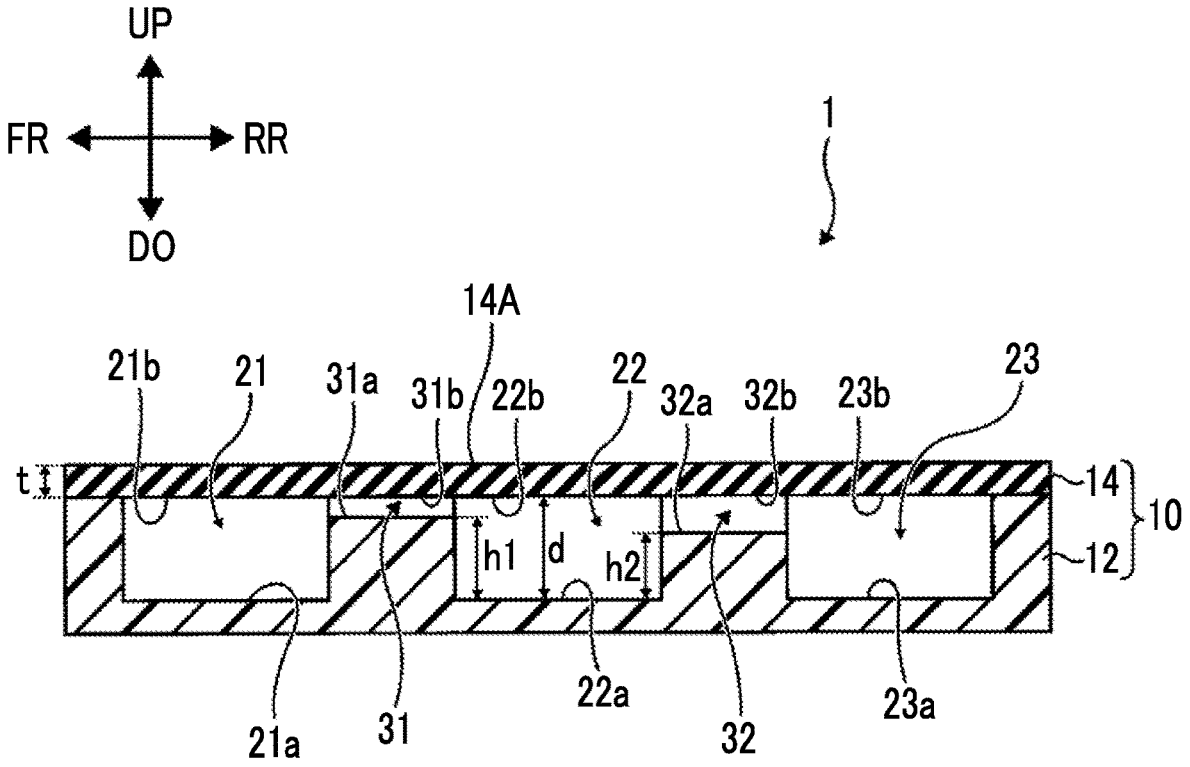
FIG. 2 is a cross-sectional view showing a schematic configuration of the test container 1.
Figure 3:
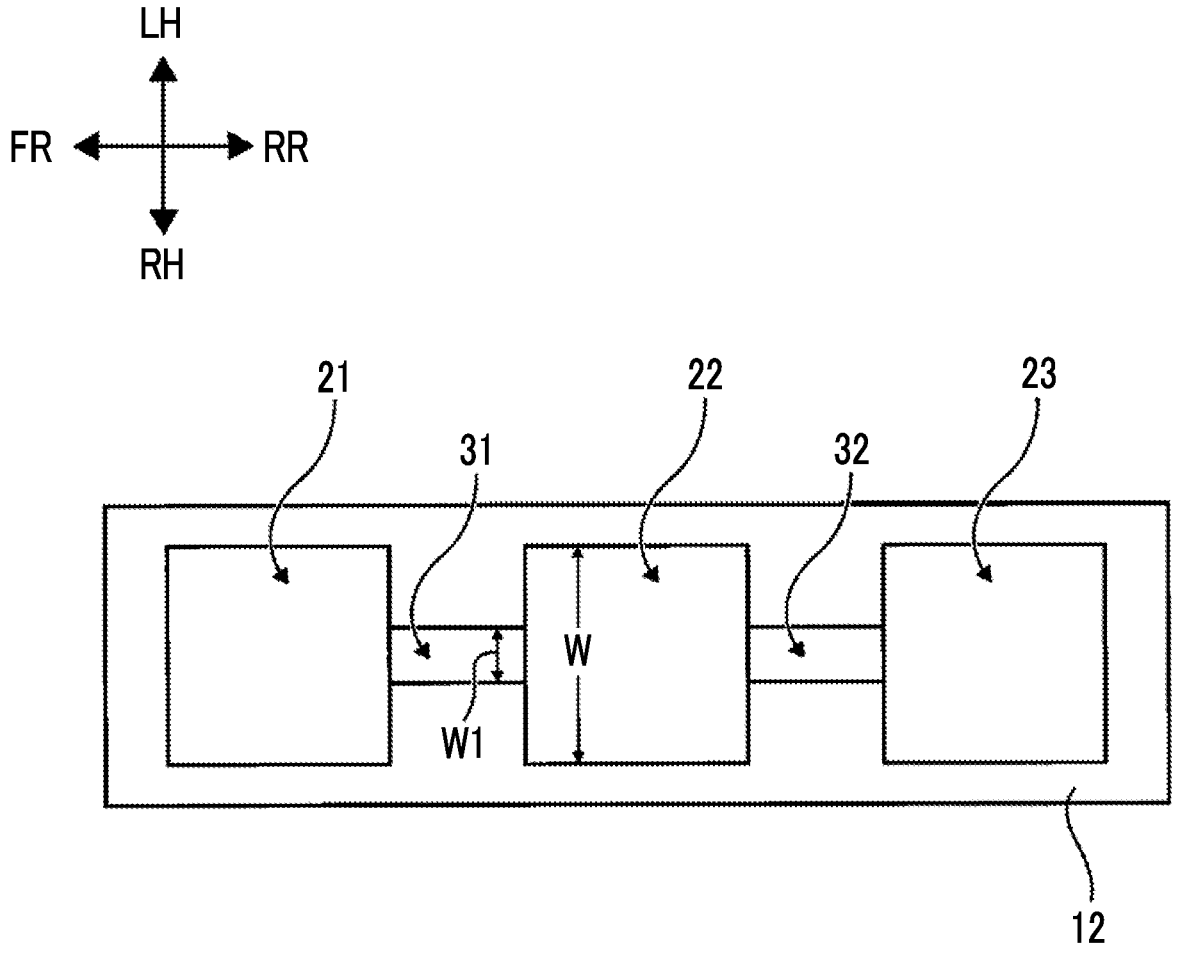
FIG. 3 is a plan view showing a schematic configuration of a main body portion of the test container 1.

A test container 1 according to a first embodiment will be described. FIG. 1 is an exploded perspective view showing a schematic configuration of the test container 1. FIG. 2 is a cross-sectional view showing a schematic configuration of the test container 1. FIG. 3 is a plan view showing a schematic configuration of a main body portion 12 of the test container 1.

The test container 1 shown in FIG. 1, FIG. 2, and FIG. 3 comprises a container main body 10 comprising a first accommodation portion 21, a second accommodation portion 22, and a third accommodation portion 23 each accommodating a liquid, a first flow path 31 connecting the first accommodation portion 21 and the second accommodation portion 22 to each other at respective upper end positions thereof, and a second flow path 32 connecting the second accommodation portion 22 and the third accommodation portion 23 to each other at respective upper end positions thereof. The container main body 10 has at least a portion 14A forming an upper wall surface 22*b* of the second accommodation portion 22 having flexibility to be deformable inwards of the second accommodation portion 22.

In this example, the container main body 10 comprises a main body portion 12 and an upper lid member 14. The main body portion 12 has an opening in a portion forming each of the first accommodation portion 21, the first flow path 31, the second accommodation portion 22, the second flow path 32, and the third accommodation portion 23. The container main body 10 has a configuration in which the first accommodation portion 21, the first flow path 31, the second accommodation portion 22, the second flow path 32, and the third accommodation portion 23 are formed therein by covering the opening of the main body portion 12 with the upper lid member 14. In other words, the main body portion 12 configures the inner bottom surfaces 21*a* to 23*a* and the side wall surfaces of the accommodation portions 21 to 23, and the inner bottom surfaces 31*a* and 32*a* and the side wall surfaces of the flow paths 31 and 32, and the upper lid member 14 configures the upper wall surfaces 21*b* to 23*b* of the accommodation portions 21 to 23 and the upper wall surfaces 31*b* and 32*b* of the flow paths 31 and 32. However, the present invention is not limited to this configuration, as long as it has a configuration of comprising each accommodation portion and each flow path therein.

In this example, the upper lid member 14 has flexibility throughout. However, the entire upper lid member 14 does not have to be flexible, as long as the portion 14A configuring at least the upper wall surface 22*b* of the second accommodation portion 22 of the container main body 10, that is, the portion 14A of the upper lid member 14 has a flexible portion deformable in a direction toward the second accommodation portion 22.

As a liquid return prevention structure, the test container 1 has a structure in which a height h1 from the inner bottom surface 22*a* of the second accommodation portion 22 to the inner bottom surface 31*a* of the first flow path 31 (hereinafter, referred to as a "height h1 of the first flow path") is higher than a height h2 from the inner bottom surface 22*a* of the second accommodation portion 22 to the inner bottom surface 32*a* of the second flow path 32 (hereinafter, referred to as a "height h2 of the second flow path"). In the test container 1, the height h1 of the inner bottom surface 31*a* of the first flow path 31 from the inner bottom surface 22*a* of the second accommodation portion 22 is defined as a height of a corner of a level difference portion between the first flow path 31 and the second accommodation portion 22 from the inner bottom surface 22*a* of the second accommodation portion 22. In the same manner, the height h2 of the inner bottom surface 32*a* of the second flow path 32 from the inner bottom surface 22*a* of the second accommodation portion 22 is defined as a height of a corner of a level difference portion between the second accommodation portion 22 and the second flow path 32 from the inner bottom surface 22*a* of the second accommodation portion 22. The liquid return prevention structure is a structure for preventing a backflow of the liquid to the first accommodation portion 21, in a case where the liquid accommodated in the second accommodation portion 22 is fed to the third accommodation portion 23 via the second flow path 32 due to the deformation of the portion 14A forming the upper wall surface 22*b* of the second accommodation portion 22 in a direction toward the second accommodation portion 22.

The test container 1 comprises the first flow path 31 at the upper end position of the first accommodation portion 21 and the second accommodation portion 22, and the second flow path 32 at the upper end position of the second accommodation portion 22 and the third accommodation portion 23, respectively. Accordingly, the liquid accommodated in the accommodation portion is difficult to flow into the flow path, compared to a case where the flow path is comprised at a lower end or in the middle in a depth direction. Therefore, it is possible to prevent a passage of the liquid into the flow path due to a capillary phenomenon or the like without applying an external force. Meanwhile, since the portion 14A deformable toward the inside of the second accommodation portion 22 is comprised at the upper portion of the second accommodation portion 22, the portion 14A is deformed toward the inside of the second accommodation portion 22 to reduce a volume of the second accommodation portion 22, thereby easily realizing liquid feeding to the third accommodation portion 23 by pushing the liquid accommodated in the second accommodation portion 22.

Since the height h1 of the first flow path 31 is higher than the height h2 of the second flow path 32, in a case where the portion 14A of the container main body 10 is deformed in the direction toward the second accommodation portion 22 so that the liquid accommodated in the second accommodation portion 22 is fed to the third accommodation portion 23 via the second flow path 32, the liquid pushed from the second accommodation portion 22 is preferentially fed to the second flow path 32 formed at a lower position. Accordingly, the liquid return to the first flow path 31 can be suppressed, and the liquid feeding properties to the third accommodation portion 23 at a downstream side is high. According to this configuration, it is possible to suppress the liquid return to the first flow path 31 and increase the liquid feeding properties to the third accommodation portion 23 with a simple configuration of providing a difference between the heights h1 and h2.

A difference h1-h2 between the height h1 of the first flow path 31 and the height h2 of the second flow path 32 is preferably 20% or more, more preferably 30% or more, and even more preferably 50% or more of the height h2 of the second flow path 32. As the difference h1-h2 is large, the liquid feeding to the second flow path 32 is further promoted, and the liquid feeding properties to the third accommodation portion 23 can be increased.

Figure 4:
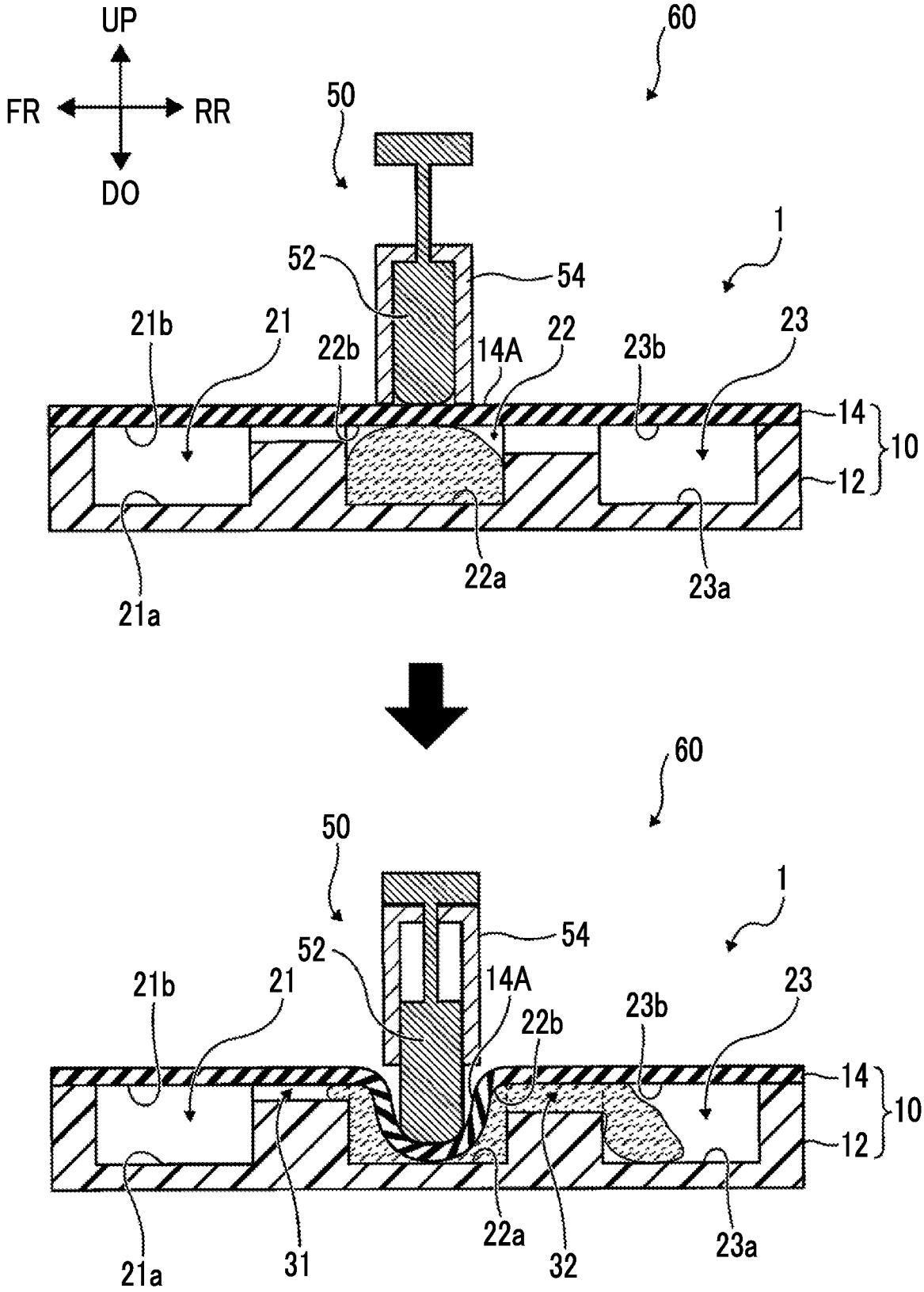
FIG. 4 is a diagram showing a liquid feeding device comprising the test container 1 and a liquid feeding method.

A liquid feeding method of the liquid in the test container 1 will be described together with a schematic configuration of a liquid feeding device 60 comprising the test container 1. FIG. 4 is a diagram for explaining a schematic configuration of the liquid feeding device 60 and a liquid feeding method. The liquid feeding device 60 comprises the test container 1, and a pressing machine 50 comprising a plunger 52 as a pressing portion.

The pressing machine 50 presses the portion 14A forming the upper wall surface 22*b* of the second accommodation portion 22 of the test container 1 toward the inside of the second accommodation portion 22 using the plunger 52. In this example, the pressing machine 50 comprises a cylinder 54 which guides the plunger 52 during the pressing operation.

As shown in the lower diagram of FIG. 4, the pressing machine 50 presses the portion 14A of the upper lid member 14 toward the inside of the second accommodation portion, so that the flexible portion 14A is deformed to the second accommodation portion 22 side. Accordingly, the volume of the second accommodation portion 22 can be reduced and the liquid in the second accommodation portion 22 can be fed to the third accommodation portion 23. The pressing portion comprised in the pressing machine 50 is not limited to the plunger as long as it can press the portion 14A toward the inside of the accommodation portion, and a rod-shaped pressing indenter, a cylinder, or the like can be selected. In addition, as for a tip shape, it is possible to appropriately select a shape such as a cylinder, a prism, a hemisphere, a cone, a polygonal pyramid, a flat shape, or a wedge shape.

The portion 14A of the container main body 10 that forms the upper wall surface 22*b* of the second accommodation portion may be pushed toward the inside of the second accommodation portion 22 to reduce the volume of the second accommodation portion 22 and is not limited to the portion 14A having flexibility throughout. For example, the central portion of the portion 14A which directly comes into contact with the plunger 52 may not have flexibility and only the surrounding portion thereof may have flexibility.

In a case where the portion 14A is formed of a flexible film or in a case where the entire upper lid member 14 is formed of a flexible film, a breaking elongation of the flexible film is preferably 100% or more and 600% or less than, more preferably 200% or more and 500% or less than, and even more preferably 200% or more and 400% or less than. In addition, in a case where a thickness of the flexible film is t μm (micrometer), a modulus of elasticity of the flexible film is α MPa (megapascal), and a depth of the second accommodation portion 22 is d μm, relationships of $0.03 \leq t/d \leq 2.5$ and $2{,}000 \leq \alpha \times t \leq 250{,}000$ are preferably satisfied. The relationships of $0.03 \leq t/d \leq 1.8$ and $2{,}000 \leq \alpha \times t \leq 110{,}000$ are more preferably satisfied, relationships of $0.08 \leq t/d \leq 1.0$ and $2{,}000 \leq \alpha \times t \leq 50{,}000$ are even more preferably satisfied, and relationships of $0.2 \leq t/d \leq 0.4$ and $4{,}000 \leq \alpha \times t \leq 20{,}000$ are particularly preferably satisfied.

As a material of the flexible film, a silicone resin, a fluororesin, polyolefin, polycarbonate, and the like are suitable.

A dispensing port for dispensing a liquid may be provided in a portion of the upper lid member 14 that forms each of the upper wall surfaces 21*b*, 22*b*, and 23*b* of the first accommodation portion 21, the second accommodation portion 22, and the third accommodation portion 23. The dispensing port is opened at the time of dispensing but is preferably sealed at other times. Alternatively, the upper lid member 14 may be provided with no dispensing port, and the upper lid member 14 may be covered and adhered to an upper surface of the main body portion 12 after injecting the liquid to each of the accommodation portions 21, 22, and 23.

In this example, the first flow path 31 and the second flow path 32 have a width W1 narrower than a width W of the second accommodation portion 22. The width W1 of the first flow path 31 and the second flow path 32 may be equal to the width W of the second accommodation portion 22, but is preferably narrower than the width of the first accommodation portion 21 and the second accommodation portion 22. The width W1 of the first flow path 31 and the second flow path 32 is preferably ½ or less and more preferably ⅓ or less of the width W of the first accommodation portion 21. The width of the first flow path 31 and the width of the second flow path 32 may or may not be the same. In addition, in this example, the first accommodation portion 21, the second accommodation portion 22, and the third accommodation portion 23 have the same shape, but they may not have the same shape.

As the material of the main body portion 12, any known resin-molded plastic materials can be used without particular limitation. Examples thereof include an acrylic resin such as a polymethyl methacrylate resin (PMMA), a polyolefin resin such as a polycarbonate resin, polyethylene (PE), polypropylene (PP), an ethylene-vinyl acetate copolymer (EVA), a cycloolefin resin such as a cycloolefin polymer (COP) and a cyclic olefin copolymer (COC), a silicone resin, a fluororesin, a polystyrene resin, a polyvinyl chloride resin, a phenol resin, a urethane resin, a polyester resin, an epoxy resin, and a cellulose resin. Particularly, from viewpoints of heat resistance and transparency, a polycarbonate resin, polypropylene, a cycloolefin resin, a silicone resin, and a fluororesin are preferable. In addition, a copolymer of these resins may be used.

A size (volume) of the first accommodation portion 21, the second accommodation portion 22, and the third accommodation portion 23 is, for example, approximately 1 μL (microliter) to several hundreds μL.

Modification Example

Figure 5:
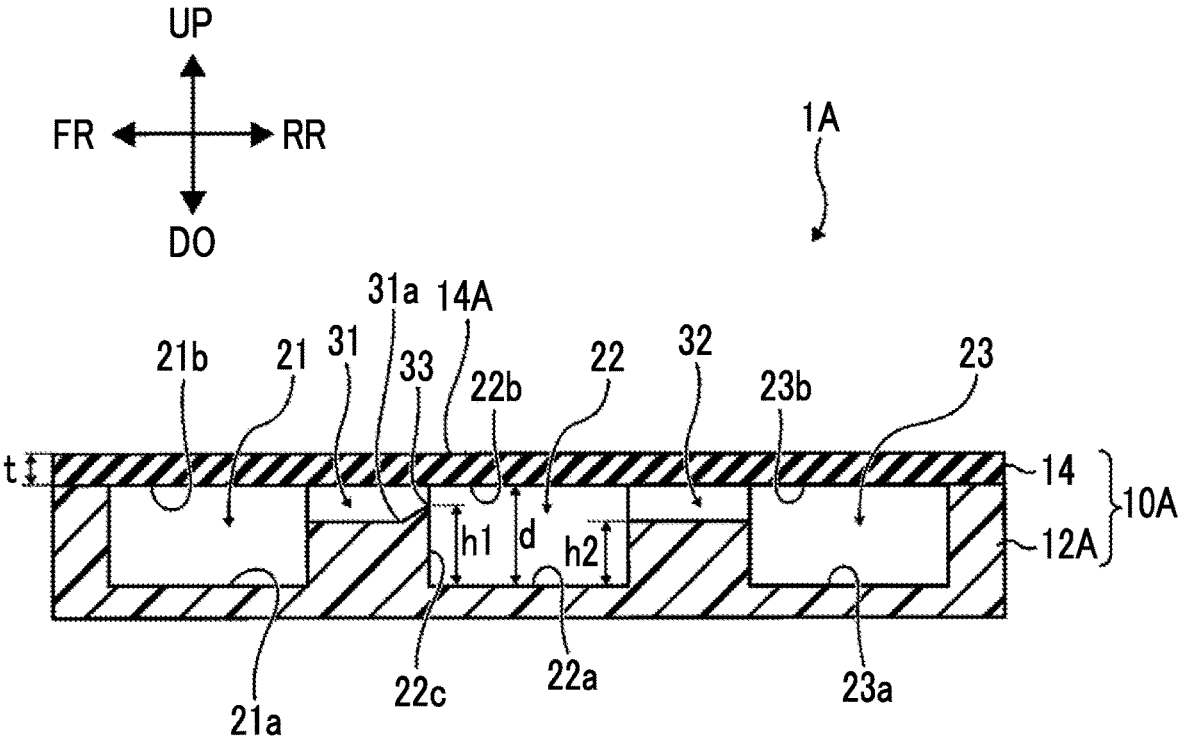
FIG. 5 is a cross-sectional view showing a schematic configuration of a test container 1A of a modification example.

FIG. 5 shows a test container 1A of a modification example of the first embodiment. The test container 1A comprises a container main body 10A consisting of a main body portion 12A and an upper lid member 14. In the test container 1A, a corner 33 formed by an inner bottom surface 31*a* of the first flow path 31 and an inner side surface 22*c* of the second accommodation portion 22 in a level difference portion between the inner bottom surface 31*a* of the first flow path 31 and the second accommodation portion 22 has an acute angle. By setting the corner 33 of the level difference portion to have an acute angle, it is possible to more effectively suppress the flow of the liquid accommodated in the second accommodation portion 22 to the first flow path, compared to a case where the angle is equal to or greater than 90°. Therefore, it is possible to more preferentially feed the liquid accommodated in the second accommodation portion 22 to the second flow path 32.

Test Container of Second Embodiment

Figure 6:
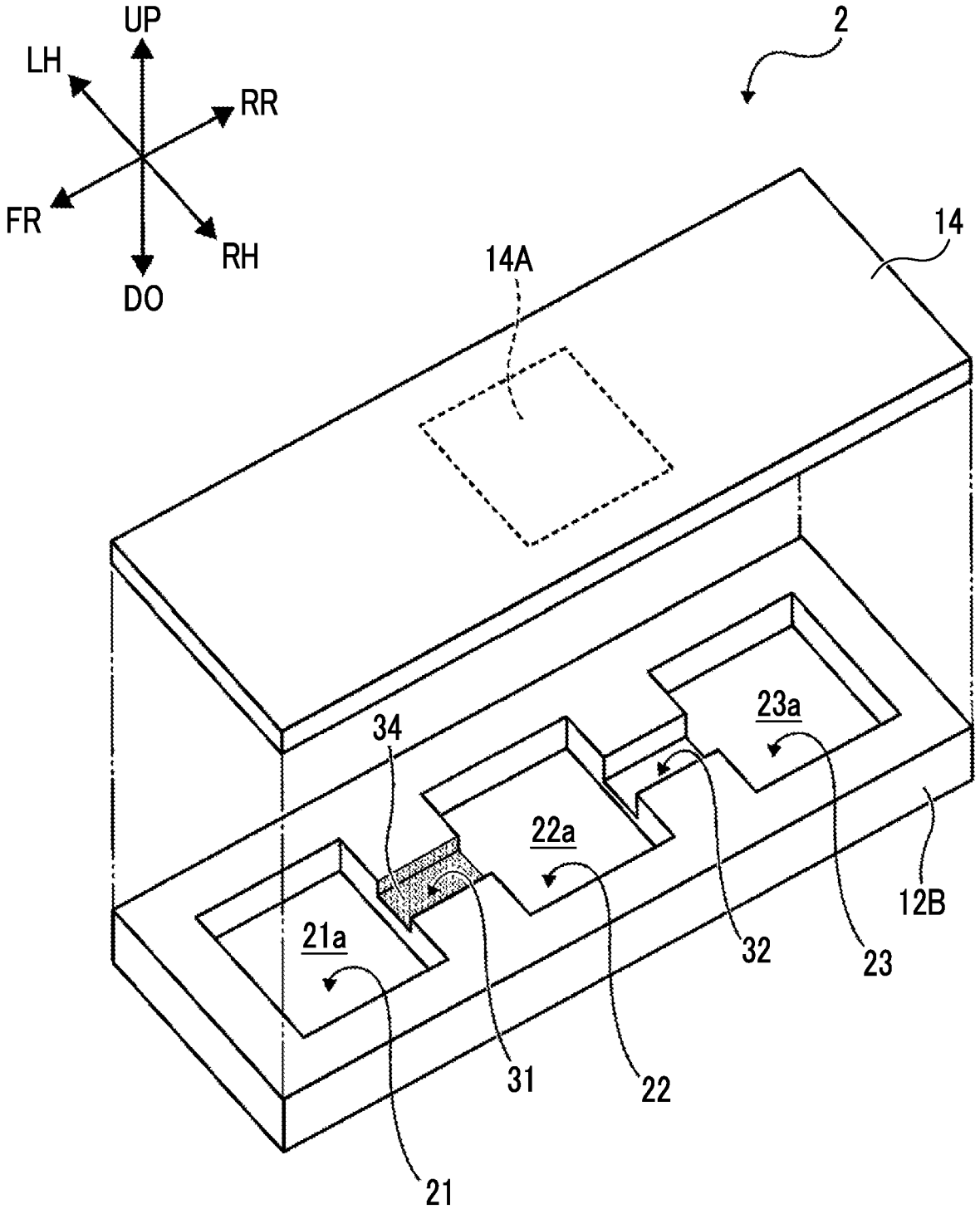
FIG. 6 is an exploded perspective view showing a schematic configuration of a test container 2.
Figure 7:
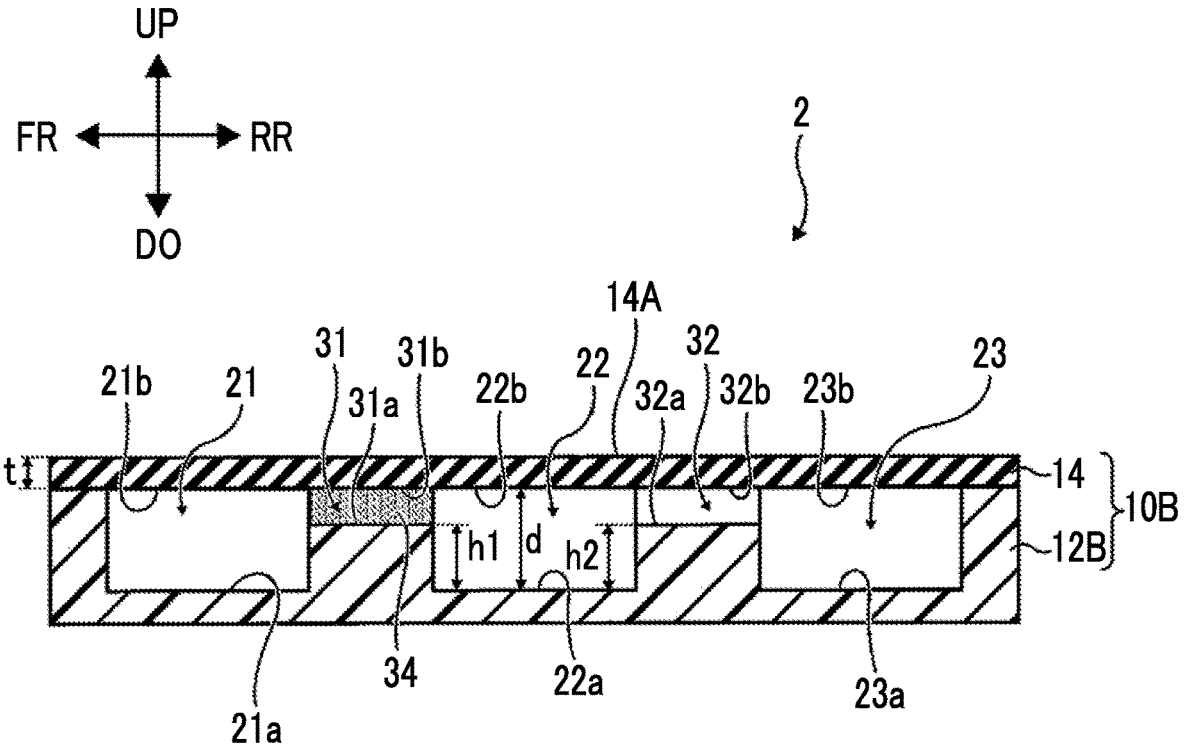
FIG. 7 is a cross-sectional view showing a schematic configuration of the test container 2.
Figure 8:
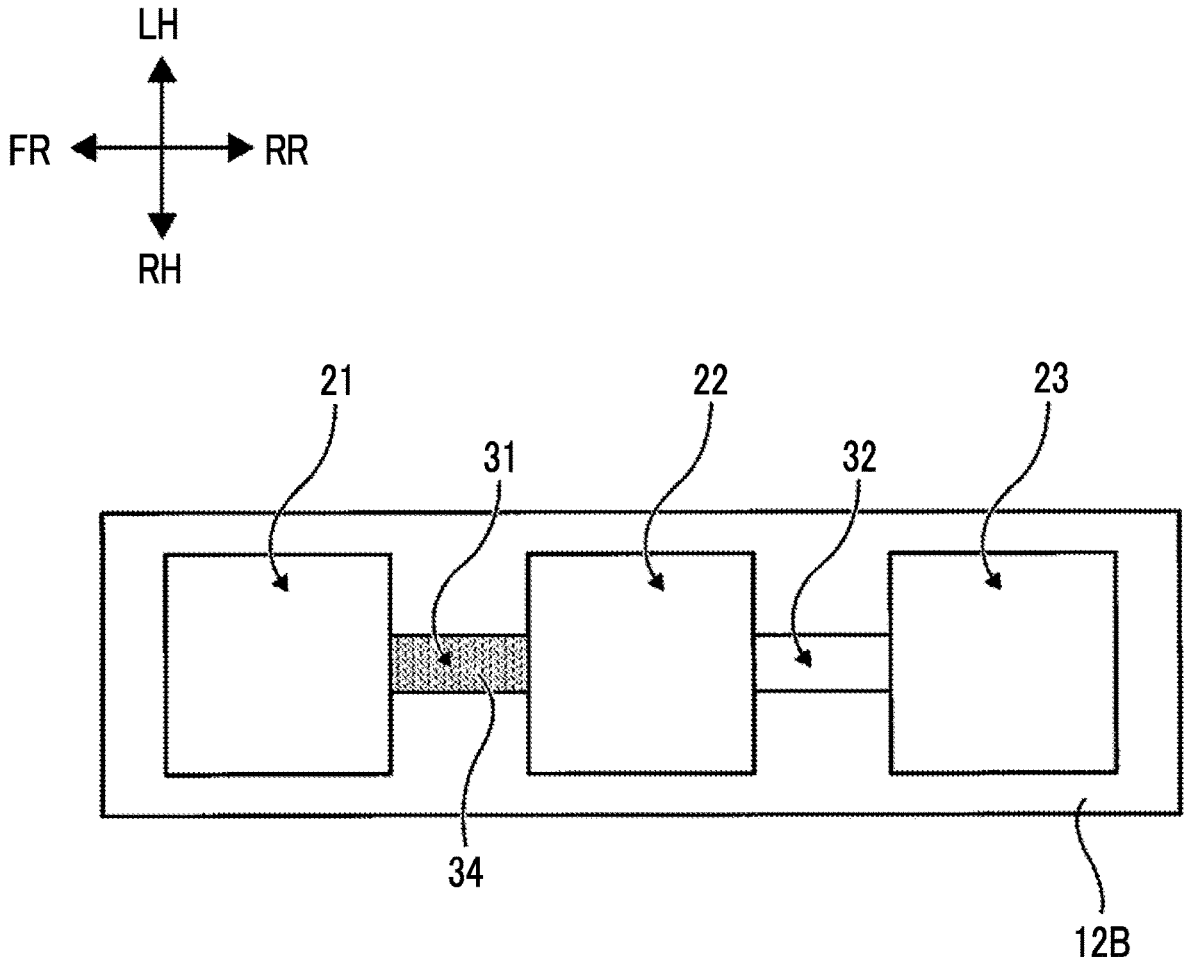
FIG. 8 is a plan view showing a schematic configuration of a main body portion of the test container 2.

A test container 2 according to a second embodiment will be described. FIG. 6 is an exploded perspective view showing a schematic configuration of the test container 2. FIG. 7 is a cross-sectional view showing a schematic configuration of the test container 2. FIG. 8 is a plan view showing a schematic configuration of a main body portion 12B of the test container 2.

The test container 2 shown in FIGS. 6, 7 and 8 comprises a container main body 10B comprising the first accommodation portion 21, the second accommodation portion 22, and the third accommodation portion 23 each accommodating a liquid, the first flow path 31 connecting the first accommodation portion 21 and the second accommodation portion 22 to each other at respective upper end positions thereof, and the second flow path 32 connecting the second accommodation portion 22 and the third accommodation portion 23 to each other at respective upper end positions thereof. The container main body 10B has at least the portion 14A forming the upper wall surface 22*b* of the second accommodation portion 22 having flexibility to be deformable inwards of the second accommodation portion 22. In the drawings, the same reference numerals are used for the same elements as those of the test container 1 of the first embodiment. Elements having the same reference numerals as those of the test container 1 are the same as those described for the test container 1, and specific description thereof will be omitted. The same applies to the following drawings.

In this example, the container main body 10B comprises the main body portion 12B and the upper lid member 14. The main body portion 12B has an opening in a portion forming each of the first accommodation portion 21, the first flow path 31, the second accommodation portion 22, the second flow path 32, and the third accommodation portion 23. The container main body 10B has a configuration in which the first accommodation portion 21, the first flow path 31, the second accommodation portion 22, the second flow path 32, and the third accommodation portion 23 are formed therein by covering the opening of the main body portion 12B with the upper lid member 14. In other words, the main body portion 12B configures the inner bottom surfaces 21*a* to 23*a* and the side wall surfaces of the accommodation portions 21 to 23, and the inner bottom surfaces 31*a* and 32*a* and the side wall surfaces of the flow paths 31 and 32, and the upper lid member 14 configures the upper wall surfaces 21*b* to 23*b* of the accommodation portions 21 to 23 and the upper wall surfaces 31*b* and 32*b* of the flow paths 31 and 32. However, the present invention is not limited to this configuration, as long as it has a configuration of comprising each accommodation portion and each flow path therein.

The test container 2 has a structure of the first flow path 31 and the second flow path 32 in which a water contact angle R1 of the inner surface of the first flow path 31 is set to be greater than a water contact angle R2 of the inner surface of the second flow path 32, as the liquid return prevention structure. In this example, a hydrophobic surface 34 obtained by performing a hydrophobic treatment is formed on the inner surface of the first flow path 31.

In order to generate a difference in a water contact angle between the inner surface of the first flow path 31 and the inner surface of the second flow path 32, the hydrophobic treatment may be performed on the inner surface of the first flow path 31 as in this example and/or a hydrophilic treatment may be performed on the inner surface of the second flow path 32.

The test container 2 comprises the first flow path 31 at the upper end position of the first accommodation portion 21 and the second accommodation portion 22, and the second flow path 32 at the upper end position of the second accommodation portion 22 and the third accommodation portion 23, respectively. Accordingly, the liquid accommodated in the accommodation portion is difficult to flow into the flow path, compared to a case where the flow path is comprised at a lower end or in the middle in a depth direction. Therefore, it is possible to prevent a passage of the liquid into the flow path due to a capillary phenomenon or the like without applying an external force. Meanwhile, since the portion 14A deformable toward the inside of the second accommodation portion 22 is comprised at the upper portion of the second accommodation portion 22, the portion 14A is deformed toward the inside of the second accommodation portion 22 to reduce a volume of the second accommodation portion 22, thereby easily realizing liquid feeding to the third accommodation portion 23 by pushing the liquid accommodated in the second accommodation portion 22.

The portion 14A of the container main body 10B is deformed in the direction toward the second accommodation portion 22, so that the liquid accommodated in the second accommodation portion 22 is fed to the third accommodation portion 23 via the second flow path 32. In this case, since the water contact angle of the inner surface of the first flow path 31 is greater than the water contact angle of the inner surface of the second flow path 32, the liquid pushed from the second accommodation portion 22 is preferentially fed to the second flow path 32 having a smaller water contact angle. Accordingly, the liquid return to the first flow path 31 can be suppressed, and the liquid feeding properties to the third accommodation portion 23 at a downstream side is high. According to this configuration, it is possible to suppress the liquid return to the first flow path 31 and increase the liquid feeding properties to the third accommodation portion 23 with a simple process of only the surface treatment.

The surface treatment such as the hydrophilic treatment or the hydrophobic treatment is preferably formed on the entire inner surface of each flow path, but a part of the inner surface may not be treated.

Examples of the hydrophilic treatment include a surface modification treatment such as a corona treatment, a plasma treatment, an ozone treatment, a treatment of applying a hydrophilic coating agent, and bonding of a hydrophilic film. Examples of the hydrophobic treatment include a treatment of applying a hydrophobic coating agent such as a fluororesin or a hydrophobic silica-containing resin, a silane coupling treatment, and bonding of a water-repellent film.

A difference R1-R2 between the water contact angle R1 of the first flow path 31 and the water contact angle R2 of the second flow path 32 is preferably 10° or more, more preferably 20° or more, even more preferably 40° or more, and further preferably 60° or more.

In the present specification, the water contact angle is a contact angle of pure water. Specifically, 1 μL of pure water is added dropwise to the inner surface of the flow path and the accommodation portion under the condition of an atmosphere temperature of 25° C., the contact angle is measured by the θ/2 method using a fully-automatic contact angle meter (model number: DM-701, Kyowa Interface Science Co., Ltd.), and an arithmetic mean value of values obtained by measuring 5 times is used.

The liquid feeding method of the liquid in the test container 2 is the same as in the case of the test container 1 of the first embodiment.

Test Container of Third Embodiment

Figure 9:
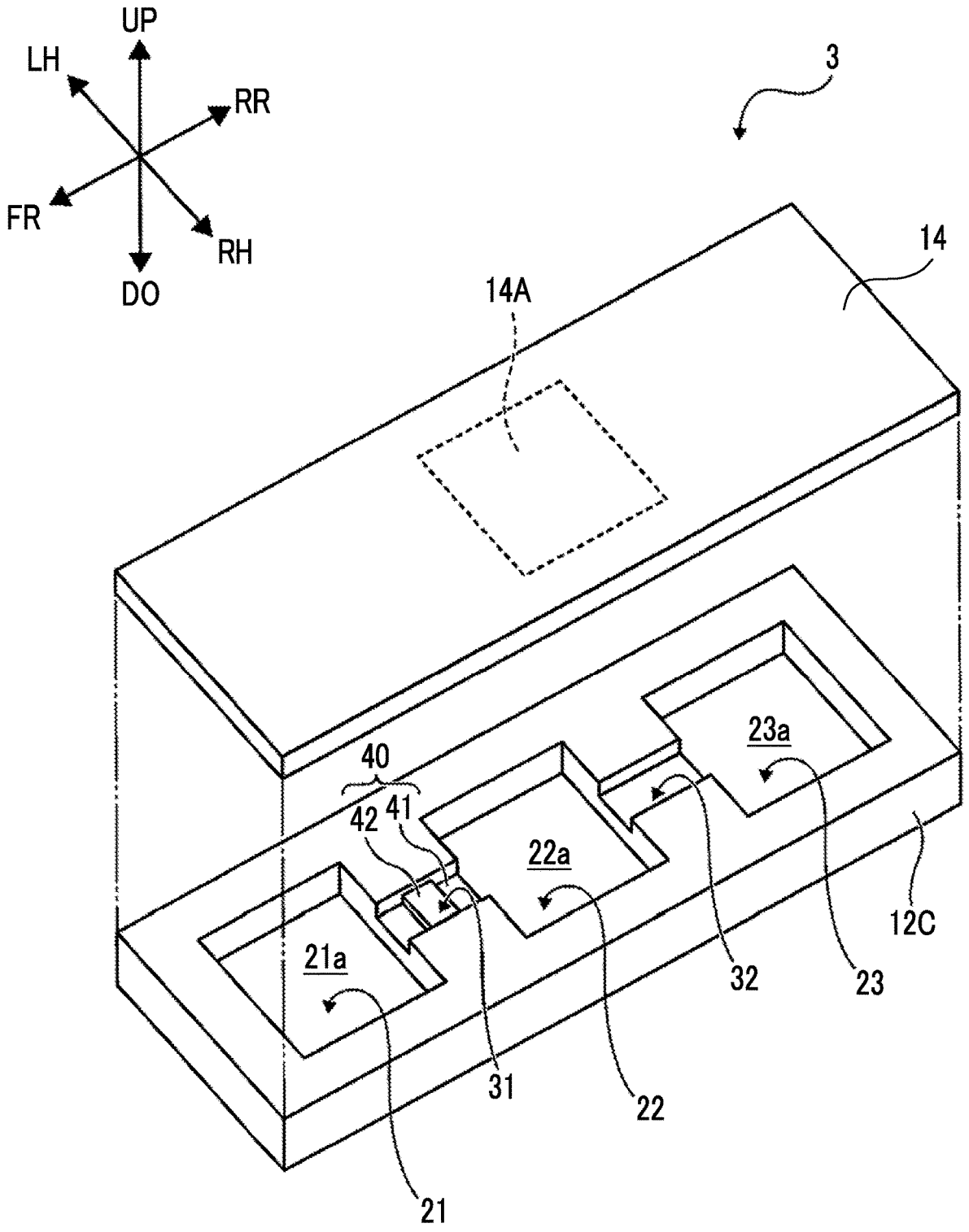
FIG. 9 is an exploded perspective view showing a schematic configuration of a test container 3.
Figure 10:
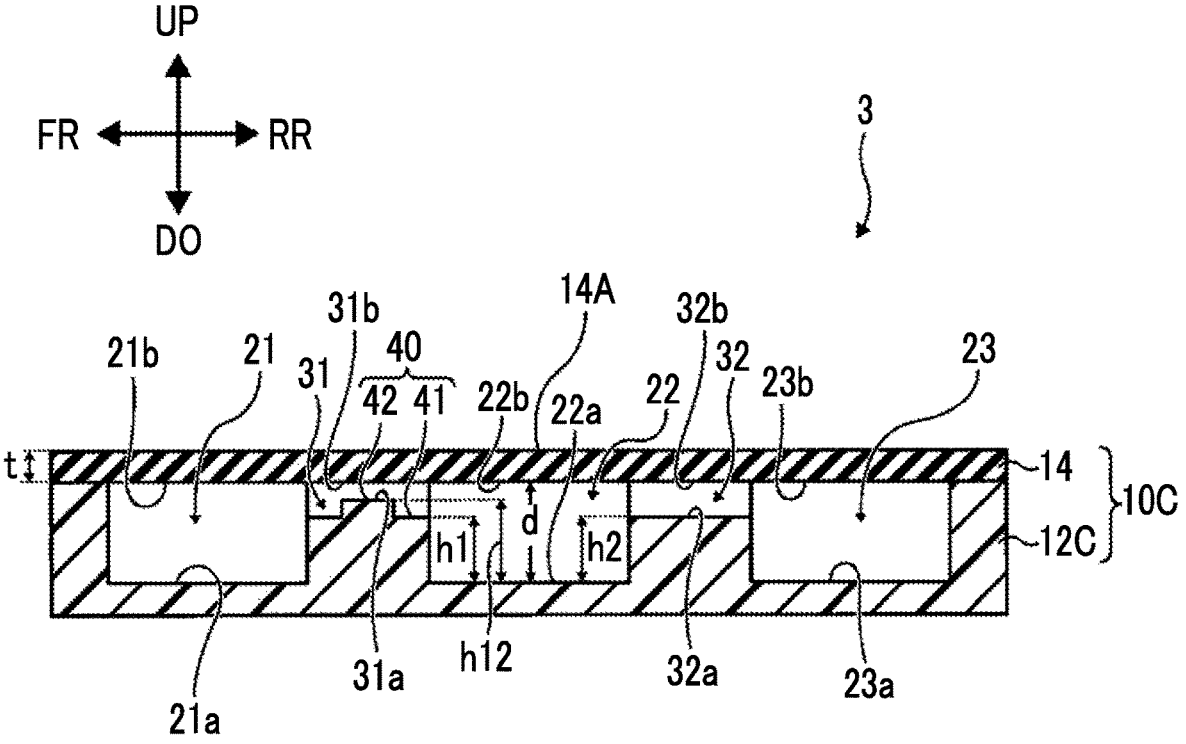
FIG. 10 is a cross-sectional view showing a schematic configuration of the test container 3.
Figure 11:
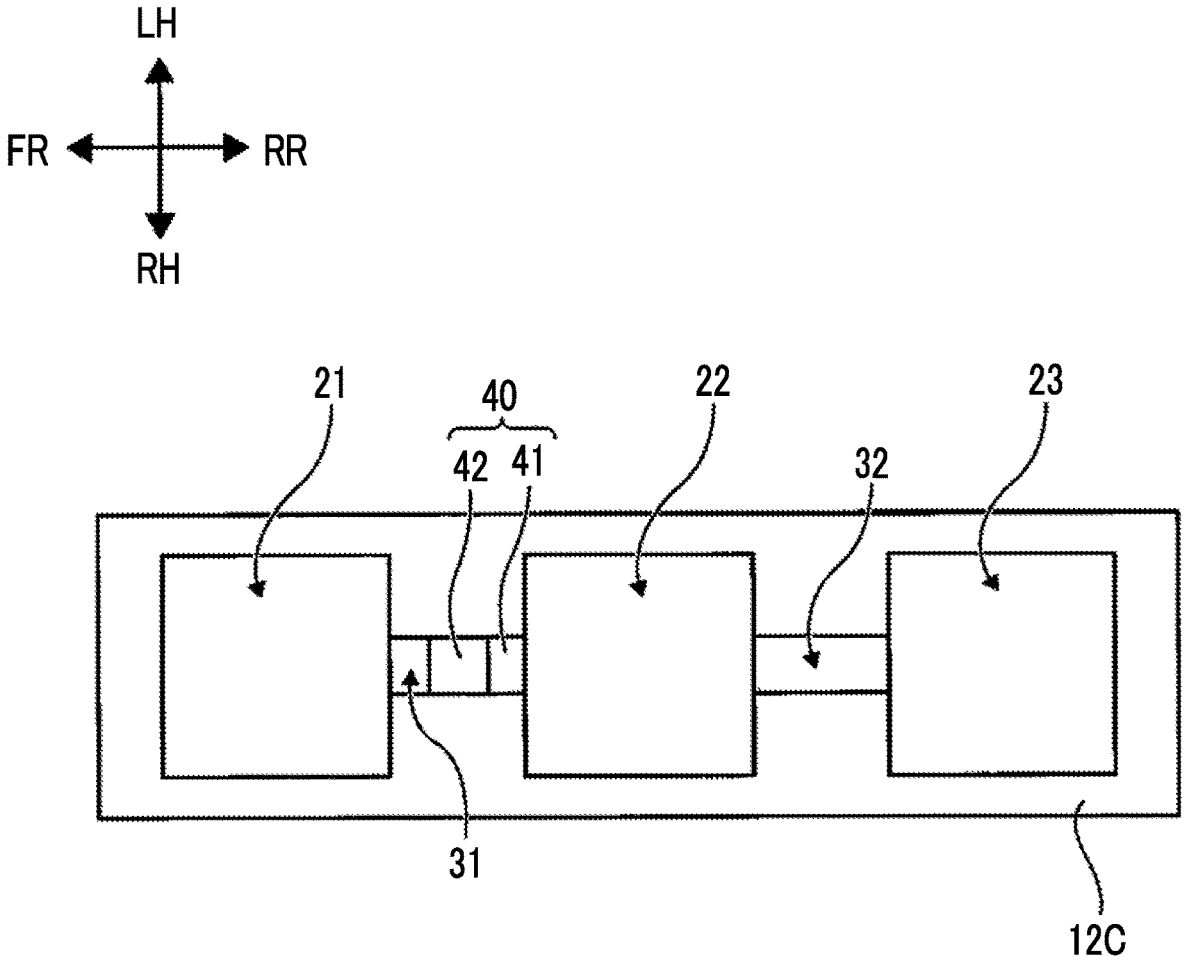
FIG. 11 is a plan view showing a schematic configuration of a main body portion of the test container 3.

A test container 3 according to a third embodiment will be described. FIG. 9 is an exploded perspective view showing a schematic configuration of the test container 3. FIG. 10 is a cross-sectional view showing a schematic configuration of the test container 3. FIG. 11 is a plan view showing a schematic configuration of a main body portion 12C of the test container 3.

The test container 3 shown in FIGS. 9, 10 and 11 comprises the container main body 10C comprising the first accommodation portion 21, the second accommodation portion 22, and the third accommodation portion 23 each accommodating a liquid, the first flow path 31 connecting the first accommodation portion 21 and the second accommodation portion 22 to each other at respective upper end positions thereof, and the second flow path 32 connecting the second accommodation portion 22 and the third accommodation portion 23 to each other at respective upper end positions thereof. The container main body 10C has at least the portion 14A forming the upper wall surface 22*b* of the second accommodation portion 22 having flexibility to be deformable inwards of the second accommodation portion 22.

In this example, the container main body 10C comprises the main body portion 12C and the upper lid member 14. The main body portion 12C has an opening in a portion forming each of the first accommodation portion 21, the first flow path 31, the second accommodation portion 22, the second flow path 32, and the third accommodation portion 23. The container main body 10C has a configuration in which the first accommodation portion 21, the first flow path 31, the second accommodation portion 22, the second flow path 32, and the third accommodation portion 23 are formed therein by covering the opening of the main body portion 12C with the upper lid member 14. That is, the main body portion 12C constitutes the inner bottom surfaces 21*a* to 23*a* and the side wall surfaces of the accommodation portions 21 to 23, and the inner bottom surfaces 31*a* and 32*a* and the side wall surfaces of the flow paths 31 and 32, respectively. The upper lid member 14 configures the upper wall surfaces 21*b* to 23*b* of the accommodation portions 21 to 23 and the upper wall surfaces 31*b* and 32*b* of the flow paths 31 and 32. However, the present invention is not limited to this configuration, as long as it has a configuration of comprising each accommodation portion and each flow path therein.

The test container 3 has a structure of a stepped portion 40 which is provided on the second accommodation portion 22 side of the first flow path 31 and which includes two or more steps 41 and 42 from the inner bottom surface 22*a* of the second accommodation portion 22, as the liquid return prevention structure. On the other hand, the second flow path 32 does not comprise a stepped portion. In addition, in this example, the stepped portion is provided on the first accommodation portion 21 side of the first flow path 31, but the stepped portion may not be provided on the first accommodation portion 21 side.

The test container 3 comprises the first flow path 31 at the upper end position of the first accommodation portion 21 and the second accommodation portion 22, and the second flow path 32 at the upper end position of the second accommodation portion 22 and the third accommodation portion 23, respectively. Accordingly, the liquid accommodated in the accommodation portion is difficult to flow into the flow path, compared to a case where the flow path is comprised at a lower end or in the middle in a depth direction. Therefore, it is possible to prevent a passage of the liquid into the flow path due to a capillary phenomenon or the like without applying an external force. Meanwhile, since the portion 14A deformable toward the inside of the second accommodation portion 22 is comprised at the upper portion of the second accommodation portion 22, the portion 14A is deformed toward the inside of the second accommodation portion 22 to reduce a volume of the second accommodation portion 22, thereby easily realizing liquid feeding to the third accommodation portion 23 by pushing the liquid accommodated in the second accommodation portion 22.

The portion 14A of the container main body 10C is deformed in the direction toward the second accommodation portion 22, so that the liquid accommodated in the second accommodation portion 22 is fed to the third accommodation portion 23 via the second flow path 32. In this case, since the first flow path 31 comprises the stepped portion 40 having two or more steps, a barrier in a case where the liquid accommodated in the second accommodation portion 22 passes through the first flow path 31 has two or more steps. Accordingly, the invasion of the liquid into the first flow path 31 is suppressed, and the liquid pushed out from the second accommodation portion 22 is preferentially fed to the second flow path 32 having a smaller barrier. Therefore, the liquid return to the first flow path 31 is suppressed, and the liquid feeding properties to the third accommodation portion 23 at a downstream side is high. It is possible to obtain a high effect of preventing the liquid return to the first flow path 31 by providing the stepped portion 40 in the first flow path 31.

The stepped portion 40 includes a first step 41 on the second accommodation portion 22 side and a second step 42. The stepped portion 40 is not limited to two steps and may have three steps or four or more steps. However, from a viewpoint of avoiding complication of the structure, the stepped portion 40 preferably has two or three steps.

The height h1 of the first step 41 is preferably 25% or more, more preferably 30% or more, and even more preferably 50% or more of d, where d is a height (depth) from the inner bottom surface 22*a* to the upper wall surface 22*b* of the second accommodation portion 22.

A height h12 of the second step 42 is preferably 50% or more, more preferably 60% or more, and even more preferably 80% or more of the height d of the second accommodation portion 22. A difference between the height h12 of the second step 42 and the height h1 of the first step 41 is preferably 20% or more of the height h1 of the first step 41, from a viewpoint of preventing the liquid return. The height h12 of the second step 42 is defined as a height from the inner bottom surface 22*a* of the second accommodation portion 22 at the corner of the level difference portion with the first step 41.

Modification Example

Figure 12:
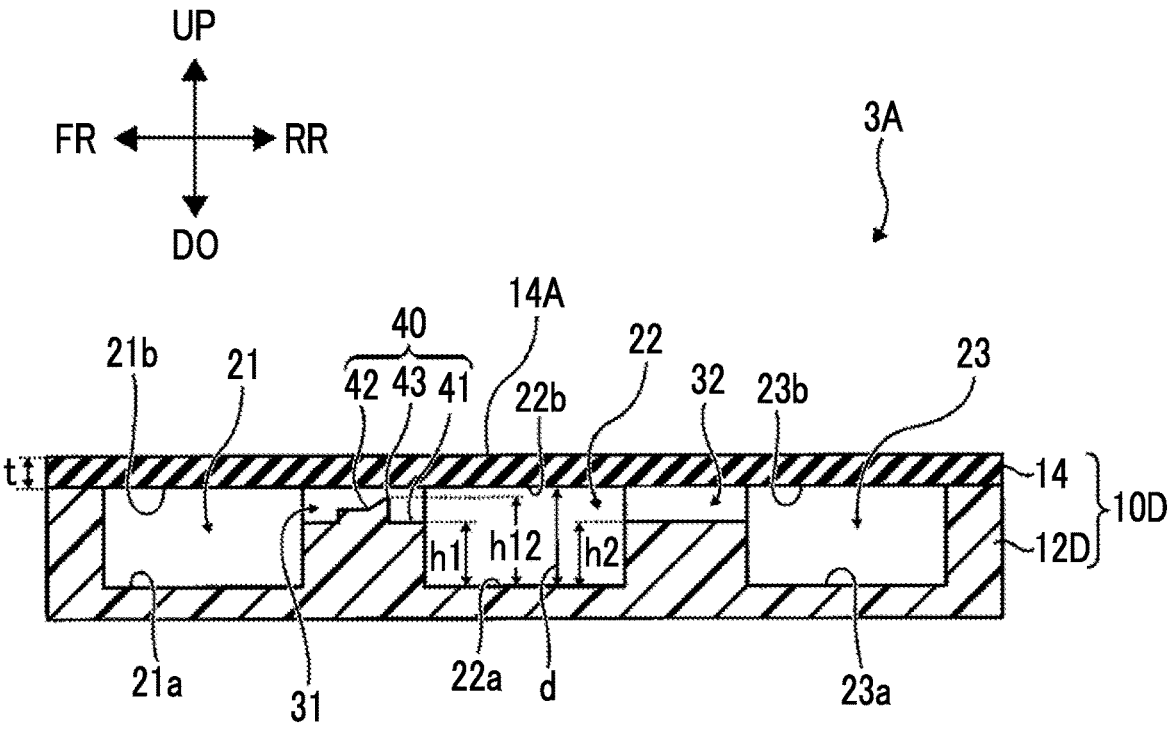
FIG. 12 is a cross-sectional view showing a schematic configuration of a test container 3A of a modification example.

FIG. 12 shows a test container 3A of a modification example of the third embodiment. The test container 3A comprises a container main body 10D consisting of a main body portion 12D and the upper lid member 14. In the test container 3A, a corner (here, a corner 43) formed by the inner bottom surface and the inner side surface forming at least one step of the stepped portion 40 has an acute angle. By setting the corner 43 of the level difference portion to have an acute angle, it is possible to more effectively suppress the flow of the liquid accommodated in the second accommodation portion 22 to the first flow path 31, compared to a case where the angle is equal to or greater than 90°. Therefore, it is possible to more preferentially feed the liquid accommodated in the second accommodation portion 22 to the second flow path 32.

In the test container 3A shown in FIG. 12, only the corner 43 of the second step 42 of the stepped portion 40 has an acute angle, but corners of all of the steps included in the flow path 31 may have an acute angle. In a case where at least one corner of the steps 41 and 42 of the stepped portion 40 is an acute angle, the effect of suppressing the flow of the liquid from the second accommodation portion 22 into the first flow path 31 is improved. In a case where the height of the inner bottom surface 31*a* of each step of the first flow path 31 from the inner bottom surface 22*a* of the second accommodation portion 22 is not constant as in the test container 3A, the height of each step is defined as the height of the corner of the step from the inner bottom surface 22*a* of the second accommodation portion 22.

The liquid feeding method of the liquid in the present test container 3 or the modification example thereof is the same as that in the case of the test container 1 of the first embodiment.

As described above, the test container 1 of the first embodiment comprises a structure in which the height h1 of the first flow path 31 is higher than the height h2 of the second flow path 32 (hereinafter, referred to as a liquid return prevention structure 1). The test container 2 of the second embodiment comprises a structure of the first flow path 31 and the second flow path 32 in which the water contact angle of the inner surface of the first flow path 31 is set to be greater than the water contact angle of the inner surface of the second flow path 32 (hereinafter, referred to as a liquid return prevention structure 2). The test container 3 of the third embodiment has a structure of the stepped portion 40 including two or more steps from the inner bottom surface 22*a* of the second accommodation portion 22 configured on the second accommodation portion side of the first flow path 31 (hereinafter, referred to as a liquid return prevention structure 3).

Figure 13:
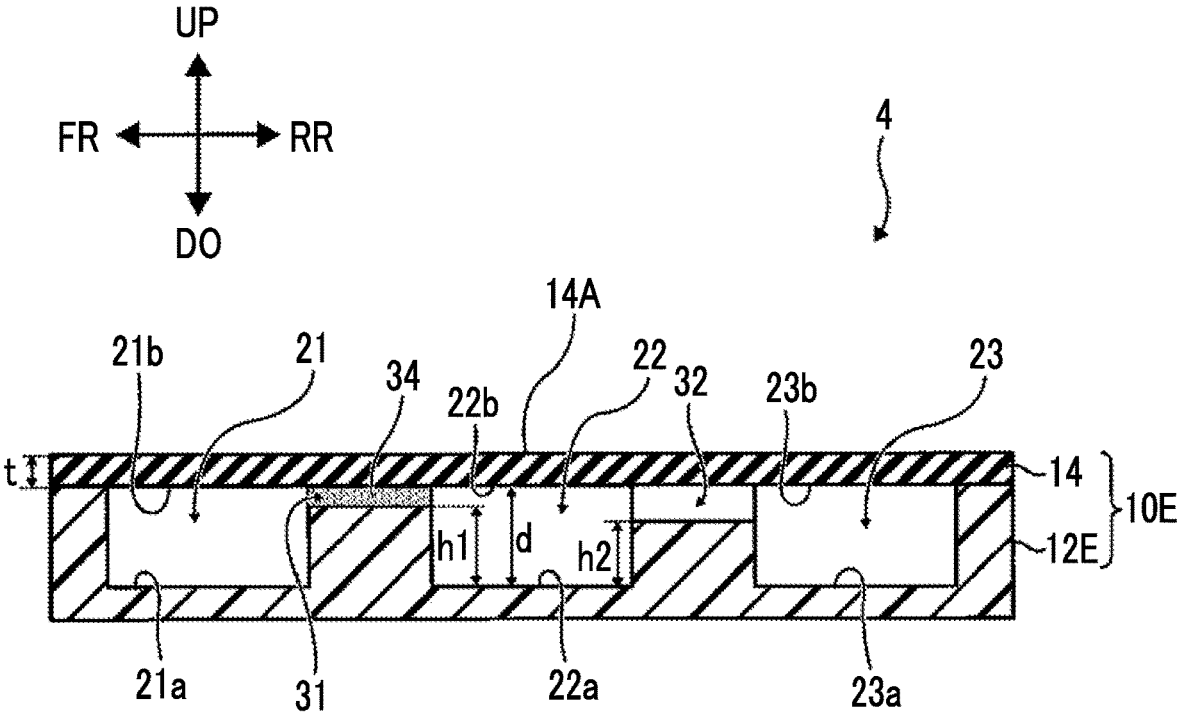
FIG. 13 is a cross-sectional view showing a schematic configuration of a test container 4.

It is also preferable to comprise these liquid return prevention structures 1 to 3 in combination. For example, as shown in FIG. 13, a test container 4 comprising the liquid return prevention structure 1 and the liquid return prevention structure 2 may be used. The test container 4 comprises a container main body 10E formed of a main body portion 12E and the upper lid member 14. The test container 4 has a structure in which the height h1 of the first flow path and the height h2 of the second flow path satisfy a relationship of h1>h2 and comprises the hydrophobic surface 34 obtained by performing a hydrophobic treatment on the inner surface of the first flow path 31, and the water contact angle of the inner surface of the first flow path 31 is higher than the water contact angle of the inner surface of the second flow path 32.

Figure 14:
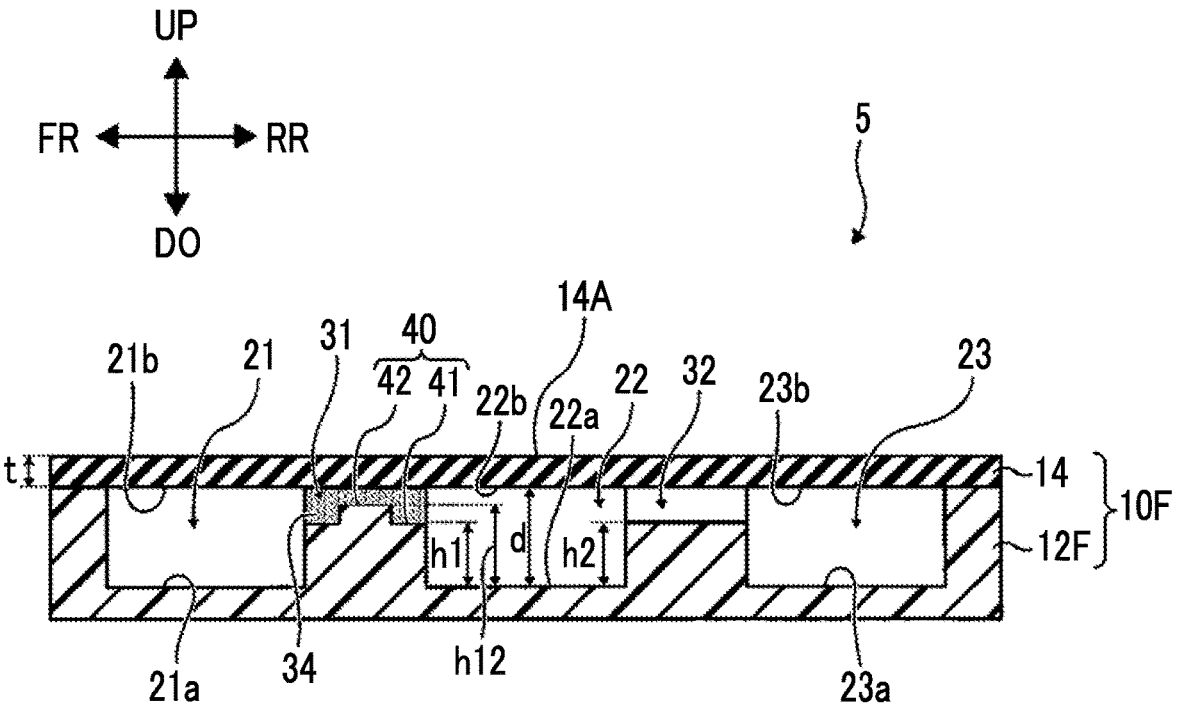
FIG. 14 is a cross-sectional view showing a schematic configuration of a test container 5.

As shown in FIG. 14, a test container 5 comprising the liquid return prevention structure 2 and the liquid return prevention structure 3 may be used. The test container 5 comprises a container main body 10F forming of a main body portion 12F and the upper lid member 14. The test container 5 comprises the hydrophobic surface 34 obtained by performing a hydrophobic treatment on the inner surface of the first flow path 31 and comprises the stepped portion 40 in the first flow path 31, and the water contact angle of the inner surface of the first flow path 31 is higher than the water contact angle of the inner surface of the second flow path 32.

Figure 15:
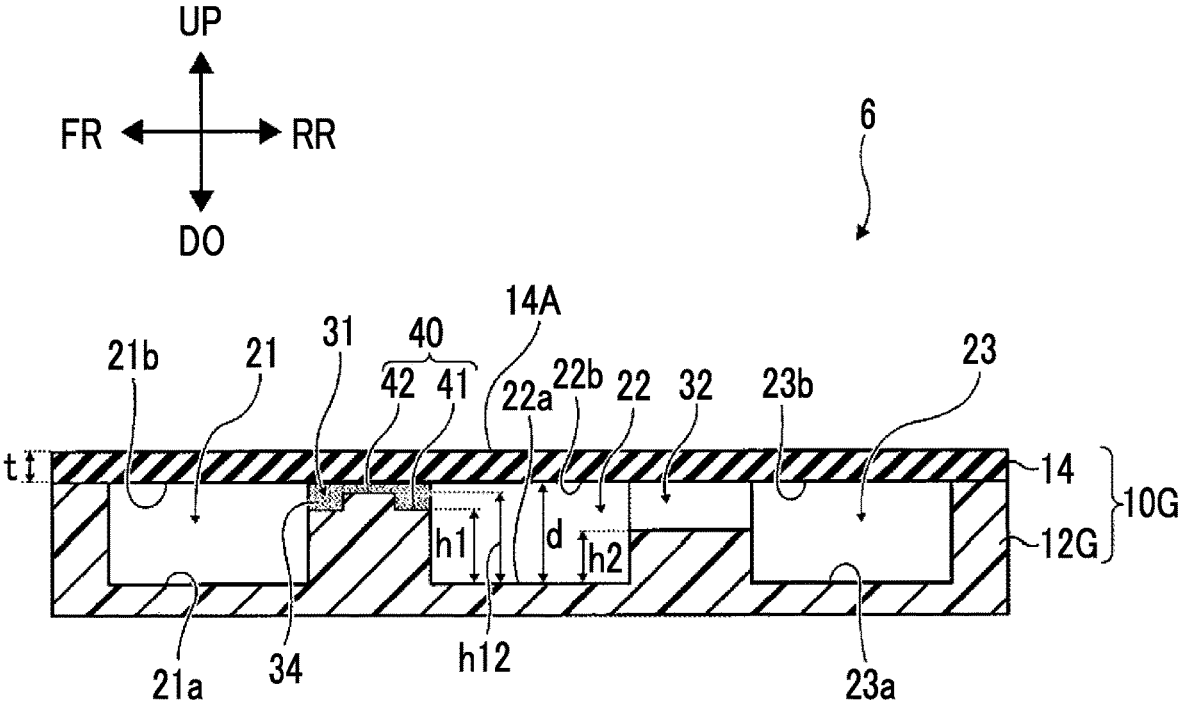
FIG. 15 is a cross-sectional view showing a schematic configuration of a test container 6.

In addition, the test container may be a test container comprising the liquid return prevention structure 1 and the liquid return prevention structure 3, or as shown in FIG. 15, a test container 6 comprising all the liquid return prevention structures 1 to 3. The test container 6 comprises a container main body 10G formed of a main body portion 12G and the upper lid member 14. The test container 6 has a structure in which the height h1 of the first flow path 31 and the height h2 of the second flow path 32 satisfy a relationship of h1>h2 and comprises the hydrophobic surface 34 obtained by performing a hydrophobic treatment on the inner surface of the first flow path 31, and the water contact angle of the inner surface of the first flow path 31 is higher than the water contact angle of the inner surface of the second flow path 32. In addition, the first flow path 31 comprises the stepped portion 40.

According to the test container comprising two or three the liquid return prevention structures 1 to 3 in combination, it is possible to obtain a higher effect of the liquid return prevention, compared to a case of comprising only the liquid return prevention structure 1, only the liquid return prevention structure 2, or only the liquid return prevention structure 3.

In addition, in the test container of the present disclosure, the liquid return prevention structure is not limited to the above example, and the first flow path between the second accommodation portion and the first accommodation portion may have a structure in which the liquid accommodated in the second accommodation portion relatively hardly flows, compared to the second flow path between the second accommodation portion and the third accommodation portion. For example, a structure including a valve may be comprised in each of the first flow path and the second flow path may be provided as the liquid return prevention structure. In a case where a valve is provided in each of the first flow path and the second flow path, the liquid is fed in a state where the valve of the first flow path is closed and valve of the second flow path is opened, in a case of feeding the liquid from the second accommodation portion to the third accommodation portion, it is possible to effectively prevent the liquid return to the first accommodation portion and improve the liquid feeding properties to the third accommodation portion.

Application Example to Nucleic Acid Extraction Test

The test container according to the embodiment of the technology of the present disclosure can be applied as, for example, a test cartridge for a nucleic acid extraction test. A nucleic acid extraction test using a test container 101 according to a fourth embodiment of the technology of the present disclosure will be described.

Figure 16:
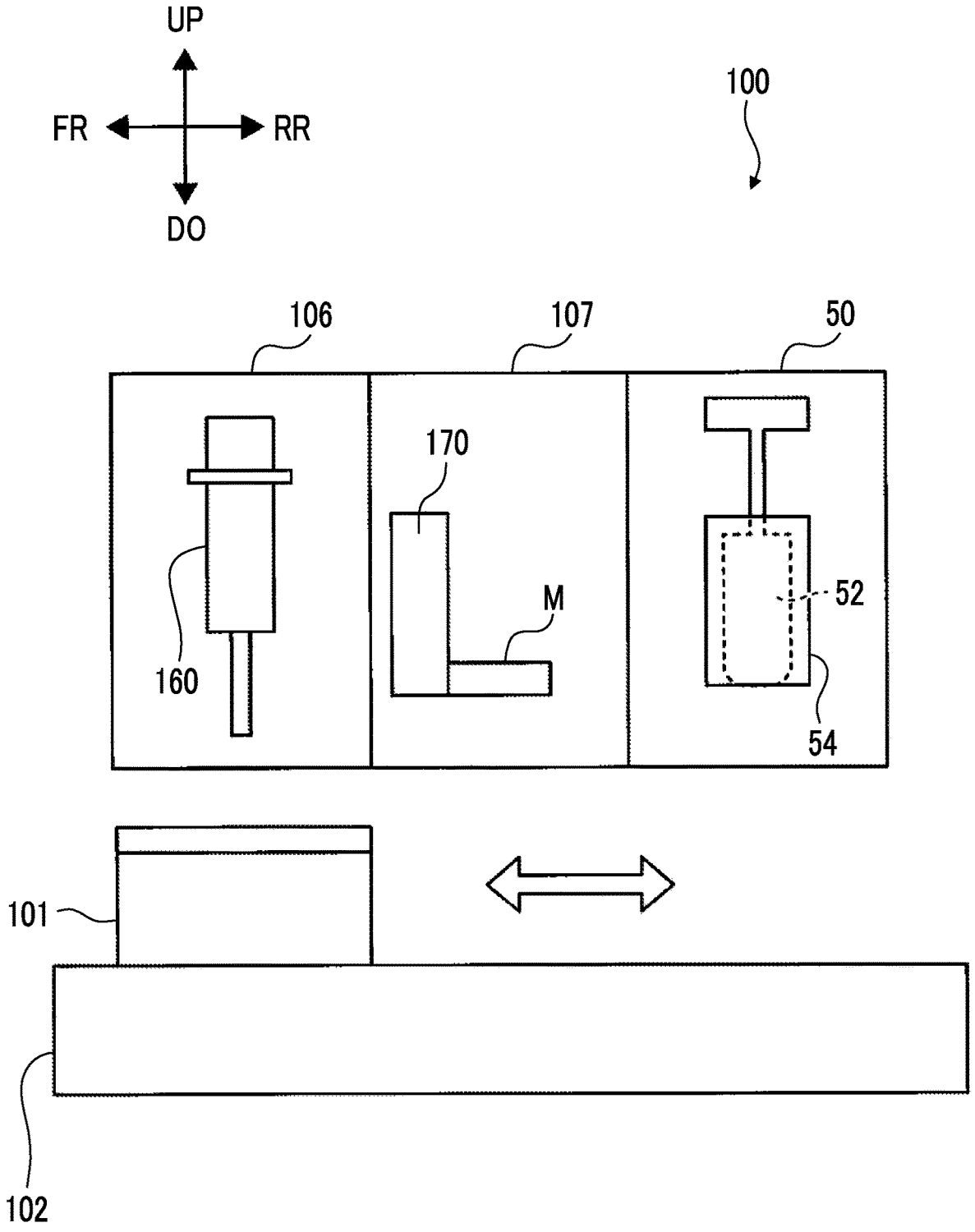
FIG. 16 is a schematic configuration diagram of a nucleic acid extraction test device 100.

FIG. 16 is a configuration diagram showing a schematic configuration of a nucleic acid extraction test device 100 comprising the test container 101. The nucleic acid extraction test device 100 comprises the test container 101, the pressing machine 50, a dispenser 106, a magnetic field generation and movement unit 107, and a transfer portion 102 for the test container 101.

Figure 17:
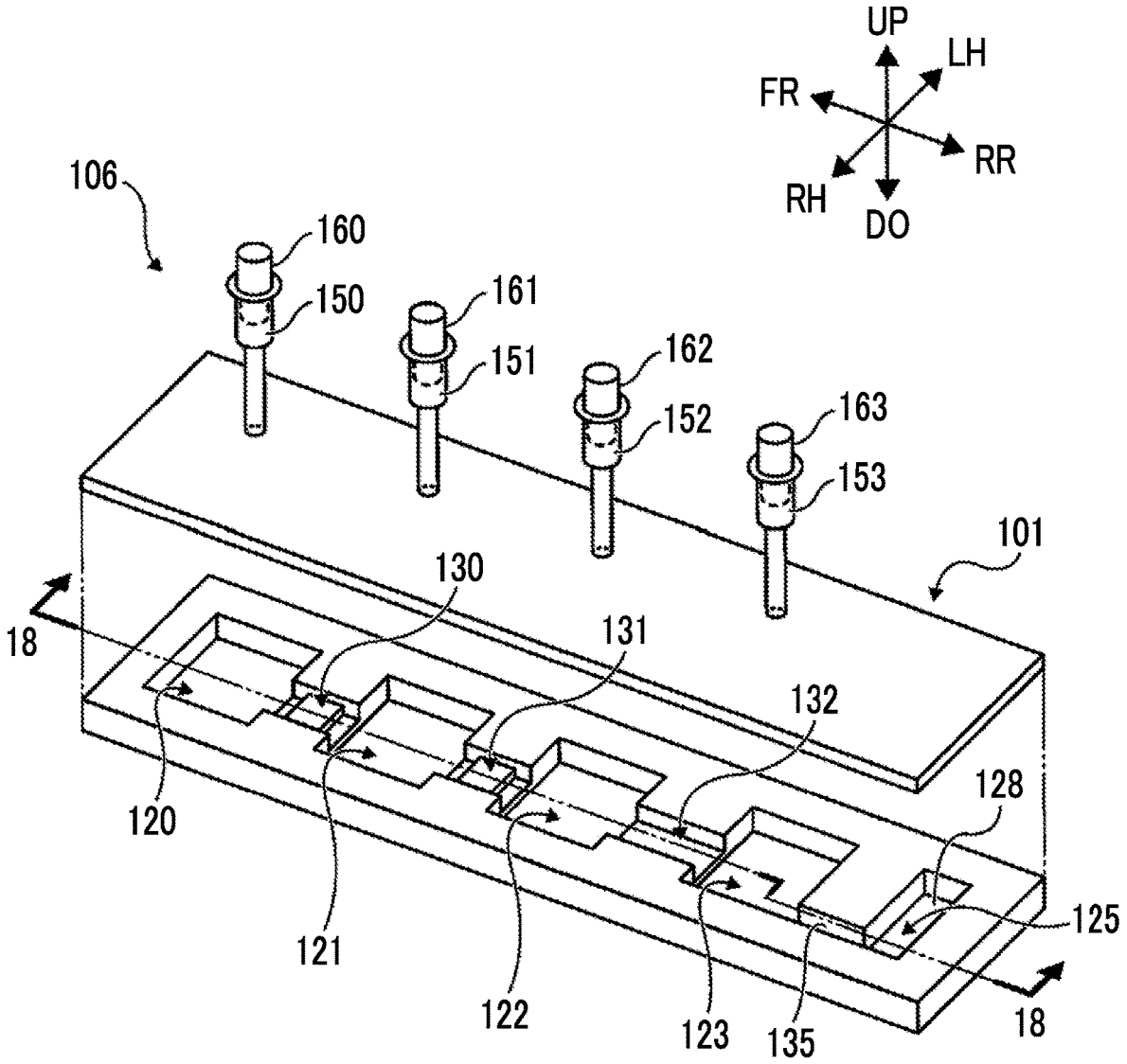
FIG. 17 is an exploded perspective view of a test container and a diagram showing a main part of a dispenser.
Figure 18:
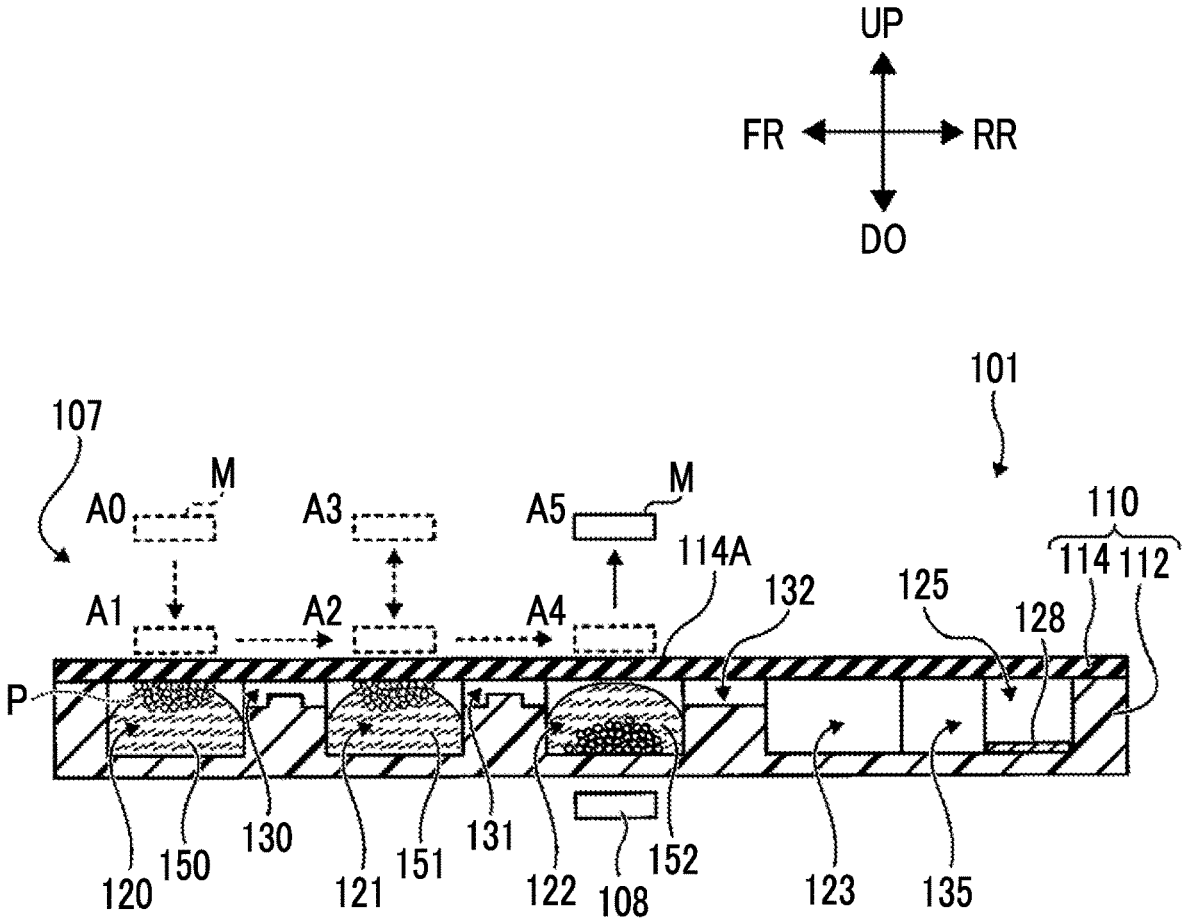
FIG. 18 is a diagram showing a cross-sectional view of a test container and a magnet.
Figure 19:
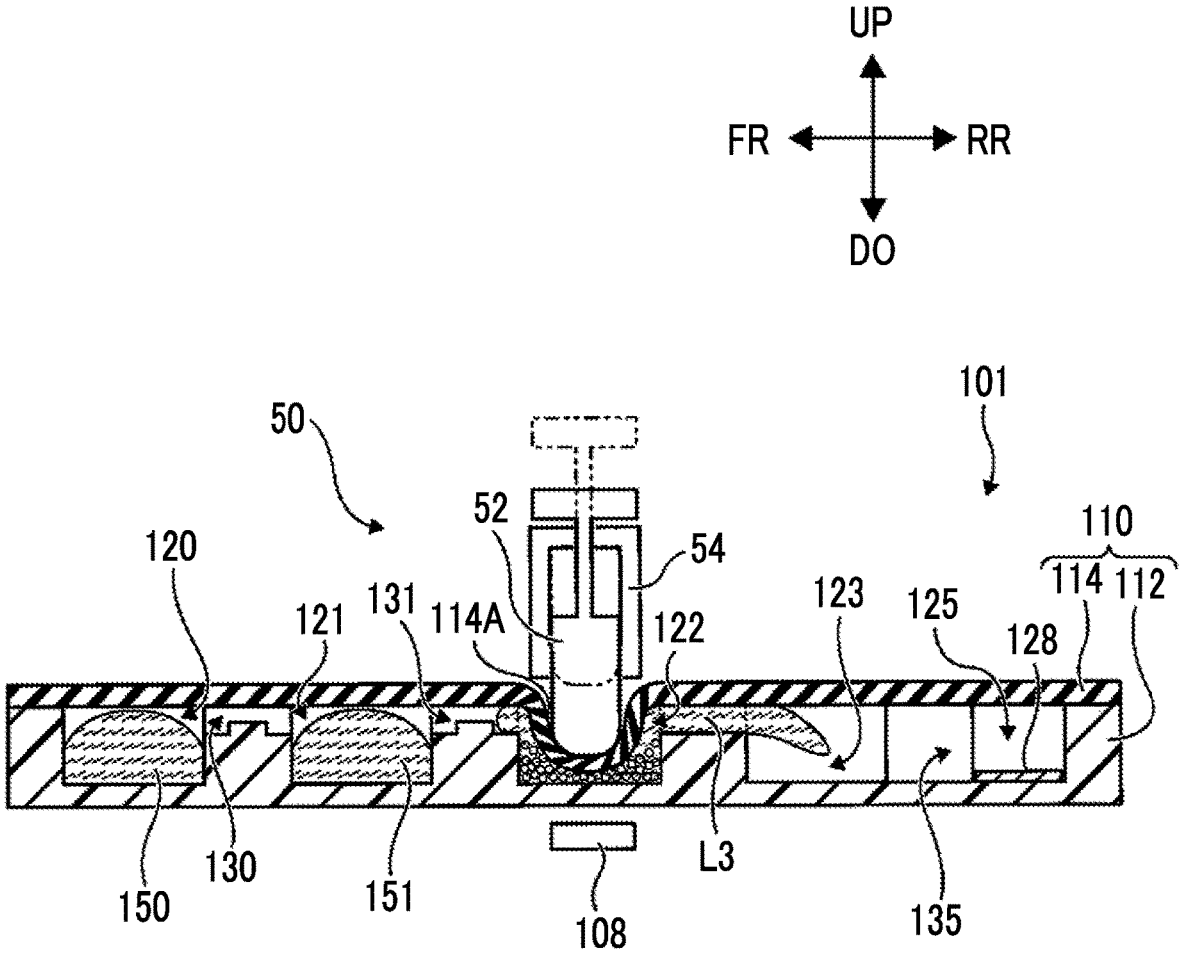
FIG. 19 is a diagram showing a cross-sectional view of the test container and a main part of a pressing machine.

FIG. 17 is an exploded perspective view of the test container 101 and a diagram showing a main part of the dispenser 106. FIG. 18 is a diagram showing the test container 101 and a magnet M of the magnetic field generation and movement unit 107. FIG. 19 is a diagram showing the test container 101 and a main part of the pressing machine 50. FIGS. 18 and 19 show cross-sectional views taken along a line 18-18 of the test container 101 shown in FIG. 17.

The test container 101 comprises a container main body 110 comprising four accommodation portions 120 to 123 accommodating a liquid, respectively, a chromatographic carrier accommodation portion 125 accommodating a chromatographic carrier 128, and four flow paths 130, 131, 132, and 135 therein.

The container main body 110 comprises a main body portion 112 and an upper lid member 114. The main body portion 112 has an opening in a portion forming each of the accommodation portions 120 to 123 and 125 and the flow paths 130, 131, 132, and 135. The container main body 110 has a configuration in which the accommodation portions 120 to 123 and 125 and the flow paths 130, 131, 132, and 135 are formed therein by covering the main body portion 112 with the upper lid member 114. The main body portion 112 configures the side wall surface and the bottom surface of each of the accommodation portions and the flow paths, and the upper lid member 114 configures the upper wall surface of each of the accommodation portions and the flow paths. In this example, the upper lid member 114 is formed of a flexible film. The upper lid member 114 is provided with an injection port (not shown) for injecting the liquid accommodated in each of the accommodation portions 120 to 123. The tips of syringes 160 to 163 are inserted into the injection ports, respectively, and various liquids can be injected into the corresponding accommodation portions 120 to 123.

The accommodation portion 120 is a magnetic particle collecting chamber (hereinafter, referred to as the magnetism collecting chamber 120) which accommodates a specimen solution 150 containing magnetic particles P to which a nucleic acid is adsorbed. The accommodation portion 121 is a cleaning chamber (hereinafter, referred to as a cleaning chamber 121) which accommodates a cleaning solution 151 and cleans a substance non-specifically adsorbed to the magnetic particles P. The accommodation portion 122 is a PCR chamber (hereinafter, referred to as a PCR chamber 122) which accommodates a polymerase chain reaction (PCR) solution 152. The accommodation portion 123 is a detection chamber (hereinafter, referred to as a detection chamber 123) for mixing an amplified nucleic acid and a development solution 153.

The flow path 130 connects a magnetism collecting chamber 120 and the cleaning chamber 121 to each other at an upper end position. The flow path 130 comprises a stepped portion on the sides of the magnetism collecting chamber 120 and the cleaning chamber 121, to suppress the flow of the specimen solution 150 accommodated in the magnetism collecting chamber 120 to the flow path 130 and to prevent the mixing of the specimen solution 150 with the cleaning solution 151 accommodated in the cleaning chamber 121.

The flow path 131 connects the cleaning chamber 121 and the PCR chamber 122 to each other at an upper end position and the flow path 132 connects the PCR chamber 122 and the detection chamber 123 to each other at an upper end position. The cleaning chamber 121, the PCR chamber 122, the detection chamber 123, and the flow paths 131 and 132 correspond to the first accommodation portion, the second accommodation portion, the third accommodation portion, the first flow path, and the second flow path in the technology of the present disclosure, respectively. In addition, here, the liquid return prevention structure of suppressing the backflow of the liquid to the cleaning chamber 121, in a case of feeding the liquid accommodated in the PCR chamber 122 to the detection chamber 123 through the flow path 132 may be comprised. In this example, the liquid return prevention structure 3 is included as the liquid return prevention structure. That is, as the liquid return prevention structure, a structure of a stepped portion including two or more steps from an inner bottom surface 122*a* of the PCR chamber 122, which is formed on the PCR chamber 122 side of the flow path 131, is comprised.

The liquid return prevention structure may include a structure (liquid return prevention structure 1) in which a height of the first flow path (flow path 131) is higher than a height of the second flow path (flow path 132). In addition, a structure of the first flow path and the second flow path in which the water contact angle of the inner surface of the first flow path is set to be greater than the water contact angle of the inner surface of the second flow path (liquid return prevention structure 2) may be included. Alternatively, two or more of other liquid return prevention structures and liquid return prevention structures 1 to 3 may be provided in combination.

The flow path 132 connects the PCR chamber 122 and the detection chamber 123 at the upper end position. The flow path 132 may comprise a valve (not shown), in order to prevent evaporation of the liquid in a case of adjusting a temperature of the PCR chamber. The valve may be any valve that can be opened in a case where liquid is fed from the PCR chamber 122 to the detection chamber 123.

The flow path 135 connects the detection chamber 123 and the chromatographic carrier accommodation portion 125 to each other at a lower end position.

The magnetic particles P are particles that are attracted by magnetic force. The magnetic particles P are, for example, magnetic particles processed so as to adsorb a specific sample such as DNA. Specifically, as the magnetic particles P, model number: Magnosphere MX100/Carboxyl and model number: Magnosphere MS160/Tosyl manufactured by JSR Corporation, sicastar manufactured by Corefront, Magrapid manufactured by Sanyo Chemical Industries, Ltd. can be used.

As the magnetic particles P, magnetic particles having a particle size in a range of 0.01 μm to 100 μm are used. As the magnetic particles P, magnetic particles having a particle size of approximately 1 μm to 10 μm are preferably used. The magnetic particles P may be comprised in the magnetism collecting chamber 120 in advance, or may be injected into the magnetism collecting chamber 120 together with the specimen solution 150.

The specimen solution 150 is, for example, a specimen solution containing a nucleic acid extracted from a specimen. The specimen solution 150 may include a surfactant for extracting a nucleic acid such as deoxyribonucleic acid (DNA) and ribonucleic acid (RNA) from the specimen and adsorbing the nucleic acid on the surfaces of the magnetic particles P. In addition, as the surfactant, for example, sodium dodecyl sulfate, polyoxyethylene sorbitan monolaurate (Tween 20), Triton X-100, or the like can be used. These surfactants may be used alone or in combination of a plurality thereof. A chaotropic substance such as guanidine hydrochloride may be included in order to promote extraction of nucleic acid from the specimen and surface adsorption to the magnetic particles P. In addition, instead of containing the surfactant, a nucleic acid extracted from a specimen using a column may be contained. In addition, a surfactant for suppressing aggregation of the magnetic particles P may be included.

The cleaning solution 151 removes the substance non-specifically adsorbed to the magnetic particles P. As the cleaning solution 151, water or a buffer solution, an organic solvent such as ethanol and isopropyl alcohol, or the like can be used. In a case where the buffer solution is used as the cleaning solution, salt is not particularly limited, but salt of tris or phosphoric acid is preferably used. In addition, in order to suppress the elution of RNA in the cleaning step, the surfactant such as sodium dodecyl sulfate, Triton X-100, or the like may be contained.

The PCR solution 152 is a solution for performing a process for amplifying nucleic acid by PCR. The PCR solution 152 contains, for example, reverse transcriptase, dNTP in which four kinds of deoxyribonucleotide triphosphates are mixed, and a primer for reverse transcriptase. Transcriptase is an enzyme that synthesizes complementary deoxyribonucleic acid (cDNA) using a base sequence of RNA as a template.

The chromatographic carrier accommodation portion 125 accommodates the chromatographic carrier 128. In the chromatographic carrier accommodation portion 125, the development solution 153 containing the amplified nucleic acid is developed. The chromatographic carrier 128 is a nucleic acid chromatographic carrier and indicates whether or not the target nucleic acid is present in the development solution 153.

The dispenser 106 comprises the syringes 160 to 163 for adding various liquids 150 to 153 to the respective accommodation portions 120 to 123 of the test container 101.

The pressing machine 50 comprises a plunger 52 is configured to be able to press a region corresponding to the PCR chamber 122 of the container main body 110 (here, the upper lid member 114) by the plunger 52.

The magnetic field generation and movement unit 107 includes the magnet M and a movement mechanism 170 that moves the magnet M.

The magnet M is, for example, a permanent magnet, but may be an electromagnet. As shown in FIG. 18, the magnet M is freely moved between positions A0 to A5 of the test container 101 on the upper lid member 114. The positions A0, A3, and A5 are positions where a magnetic force does not act on the magnetic particles P accommodated in the test container 101, even in a case where the magnet M is disposed. The position A1 is a position on the magnetism collecting chamber 120 and is a position where a magnetic force acts on the magnetic particles P in the magnetism collecting chamber 120 in a case where the magnet M is disposed. The position A2 is a position on the cleaning chamber 121 and is a position where magnetic force acts on the magnetic particles P in the cleaning chamber 121 in a case where the magnet M is disposed. The position A4 is a position on the PCR chamber 122 and is a position where a magnetic force acts on the magnetic particles P in the PCR chamber 122 in a case where the magnet M is disposed.

In a case of moving the magnetic particles P from the magnetism collecting chamber 120 to the cleaning chamber 121, first, the magnet M is disposed at the position A1. In a case where the magnet M is disposed at the position A1, the magnetic particles P accommodated in the magnetism collecting chamber 120 are collected by the magnetic force of the magnet M and are attracted and collected at the position corresponding to the magnet M with the upper lid member 14 interposed therebetween. In a case where the magnet M is moved to the position A2 along the upper lid member 14 from this state, the magnetic particles P are separated from the specimen solution 150 and moved to the cleaning chamber 121 according to the movement of the magnet M. Then, in a case where the magnet M is moved to the position A3, the magnetic particles P are dispersed in the cleaning solution 152.

In the same manner, in a case of moving the magnetic particles P from the cleaning chamber 121 to the PCR chamber 122, first, the magnet M is disposed at the position A2. In a case where the magnet M is disposed at the position A2, the magnetic particles P accommodated in the cleaning chamber 121 are attracted and collected at the position corresponding to the magnet M with the upper lid member 14 interposed therebetween. In a case where the magnet M is moved to the position A4 along the upper lid member 14 from this state, the magnetic particles P are separated from the cleaning solution 151 and moved to the PCR chamber 122 along the movement of the magnet M. After that, in a case where the magnet M is moved to the position A5, the magnetic particles P are dispersed in the PCR solution 152.

The movement mechanism 170 has a function of allowing the magnet M to pass the upper portion of the flow path 130 from the position A1 on the magnetism collecting chamber 120, to pass the upper portion of the flow path 131 from the position A2 on the cleaning chamber 121, and to freely move to the position A4 on the PCR chamber 122. In addition, the movement mechanism 170 moves the magnet M to the positions A0, A3 and A5 where the magnetic force does not reach the inside of the chambers 120, 121 and 122.

The nucleic acid extraction test device 100 further comprises a temperature control unit 108 (see FIG. 18). The temperature control unit 108 controls a temperature of the PCR solution in the PCR chamber 122. The temperature control unit 108 comprises a heating unit such as a heater or a Peltier element for heating a solution, and a cooling unit such as a Peltier element, a fan, a heat sink, or a liquid cooling mechanism for cooling a solution. The temperature control unit 108 raises or lowers the temperature of the solution so that the temperature is adjusted to a suitable temperature in each step of a heat denaturation step, an annealing step, and an extension step in PCR.

A transportation unit 102 is a device that relatively moves the test container 101 relatively to the dispenser 106, the magnetic field generation and movement unit 107, and the pressing machine 50. The transportation unit 102 may transport only the test container 101, or move the respective positions of the dispenser 106, the magnetic field generation and movement unit 107, and the pressing machine 50 with respect to the test container 101.

Nucleic Acid Extraction Test Method

The steps of the nucleic acid extraction test in the nucleic acid extraction test device 100 comprising the test container 101 will be described.

Pretreatment (Adsorption Process)

A sample containing RNA is mixed with a solution containing a surfactant that dissolves a cell membrane and the magnetic particles P to adsorb the RNA to the magnetic particles P. The sample containing RNA is not particularly limited, as long as it contains the RNA such as a biological sample and virus. As necessary, impurities may be removed with a filter or the like.

Magnetization Collection Process

The specimen solution 150 containing the magnetic particles P having RNA adsorbed, which was obtained in the pretreatment, is injected into the magnetism collecting chamber 120 by the syringe 160. After that, the magnet M is set at the position A1 on the magnetism collecting chamber 120. Accordingly, the magnetic particles P accommodated in the magnetism collecting chamber 120 are attracted to the magnet M and are collected at a position corresponding to the magnet M on the upper surface to be in an aggregated state (see FIG. 18).

In the magnetism collecting chamber 120, the adsorption process and the magnetism collection process may be performed in time series.

Then, by moving the magnet M along the flow path 130, the magnetic particles P are separated from the specimen solution 150 and moved to the cleaning chamber 121.

Cleaning Step

In the cleaning chamber 121, the magnetic particles P adsorbed with RNA are cleaned with the cleaning solution 151 accommodated in the cleaning chamber 121. The cleaning chamber 121 may be filled with the cleaning solution 151 in advance, or the cleaning solution 151 may be injected after the magnetic particles P are moved. The magnet M is moved to the position (position A3) where the magnetic force does not affect the cleaning chamber 121 and the magnetic particles P are dispersed in the cleaning solution 151, thereby promoting the cleaning. By performing the cleaning, the substances other than RNA that are non-specifically bound to the magnetic particles P are removed.

Then, by returning the magnet M to the position A2 on the cleaning chamber 121, the magnetic particles P are collected again at the position (position A2) corresponding to the magnet M on the upper surface, and the magnet M is moved to the position A4 on the PCR chamber 122 along the flow path 135, thereby separating the magnetic particles P from the cleaning solution 151 and moving the magnetic particles to the PCR chamber 122. After that, the magnet M is moved to the position A5 where the magnetic force does not affect the PCR chamber 122, so that the magnetic particles P are dispersed in the PCR solution 152.

PCR Process

In the PCR chamber 122, the RNA adsorbed to the magnetic particles P is eluted into the PCR solution 152, and the DNA amplification by PCR is performed. The cDNA is synthesized from the extracted RNA and the cDNA is amplified by PCR. In this case, the magnetic particles sink to the inner bottom surface of the PCR chamber 122 due to gravity.

Liquid Feeding Process

After the PCR step, the solution containing the amplified cDNA in the PCR chamber 122 is fed to the detection chamber 123. The test container 101 comprises the flow path 131 at the upper end position of the cleaning chamber 121 and the PCR chamber 122, and the flow path 132 at the upper end position of the PCR chamber 122 and the detection chamber 123, respectively. Accordingly, it is possible to prevent the passage of the solution 152 from the PCR chamber 122 to the flow paths 131 and 132 due to a capillary phenomenon or the like, before this liquid feeding process.

In a case where the liquid is fed, the plunger 52 is positioned on the PCR chamber 122 and the plunger 52 is pushed down along the cylinder 54. A portion 114A of the flexible upper lid member 114 is pushed by the plunger 52 and pushed inwards of the PCR chamber 122. This reduces the volume of the PCR chamber 122, so that the liquid in the PCR chamber 122 is fed to the detection chamber 123 through the flow path. In this case, since the return prevention structure is provided, most of the solution 152 in the PCR chamber 122 does not flow backward to the cleaning chamber 121 side, and a large amount of the solution extruded from the PCR chamber 122 can be fed to the detection chamber 123. In addition, since the flow path 132 is comprised at the upper end position of the PCR chamber 122, a supernatant portion of the PCR solution can be preferentially fed while the magnetic particles P are submerged on the inner bottom surface, and the magnetic particles P can be suppressed from flowing out to the detection chamber 123 side. By suppressing the magnetic particles P from flowing to the detection chamber 123, it is possible to perform a test with less noise in the next step.

Detection Process

In the detection chamber 123, the solution containing cDNA is mixed with the development solution. After that, the mixed liquid passes through the flow path 135 and is developed by the nucleic acid chromatographic carrier (chromatographic carrier 128) disposed in the chromatographic carrier accommodation portion 125. In a case where the RNA to be tested is contained, a positive result is obtained, and in a case where not, a negative result is obtained.

The nucleic acid extraction test is performed as described above.

Hereinabove, the case where the reverse transcription PCR method is used as the amplification method has been described, but the amplification method is not limited to the reverse transcription PCR method, and well-known amplification methods such as the transcription PCR method, the isothermal amplification method (for example, Nucleic Acid Sequence-Based Amplification (NASBA), Loop-mediated Isothermal Amplification (LAMP), transcription-reverse transcription concerted (TRC), and the like) can be used. In addition, hereinabove, the case where the nucleic acid chromatography method is used as the detection method has been described above, but the detection method is not limited to the nucleic acid chromatography method, and well-known methods such as a fluorescence detection method (intercalator method, probe method, or the like), a light scattering method using gold nanoparticles, a sequence method, an electrochemical method, a piezoelectric method, and detection of a weight or a mechanical change can be used. In these cases, the container does not necessarily comprise the chromatographic carrier 128 and the accommodation portion 125 thereof. On the other hand, the test device may comprise a detection unit suitable for various detection methods of a fluorescence detection unit and the like for detecting fluorescence from the detection chamber 123. However, the nucleic acid chromatography method is preferable because a high-priced detection system and detection equipment are not necessary and the operation in the analysis is simple.

By using the test container 101, the solution containing the DNA amplified in the PCR chamber 122 can be efficiently fed to the detection chamber 123 while suppressing the backflow to the cleaning chamber 121, and a sufficient amount of solution to be fed can be realized. Since the backflow can be suppressed to increase the amount of liquid to be fed to the detection chamber 123, a total amount of DNA that flows into the detection chamber 123 can be increased, which leads to improvement in determination accuracy.

In regard to the test container 101, a set of the test container 101, the magnetic particles P, and various treatment liquids such as the cleaning solution 151, the PCR solution 152, and the development solution 153 can also be provided as a test kit. The test kit may further include other treatment liquid such as a nucleic acid eluate. In addition, as the test kit, it is also possible to provide a set of only the test container 101 and the magnetic particles P. The magnetic particles P may be set in the magnetism collecting chamber 120 of the test container 101 in advance, or may be separately prepared.

The technology of the present disclosure is not limited to the embodiment described above, and various modifications, changes, and improvements can be made without departing from the spirit of the invention. For example, the modification examples described above may be appropriately configured in combination.

EXAMPLES

Hereinafter, more specific examples and comparative examples of the technology of the present disclosure will be described.

Figure 20:
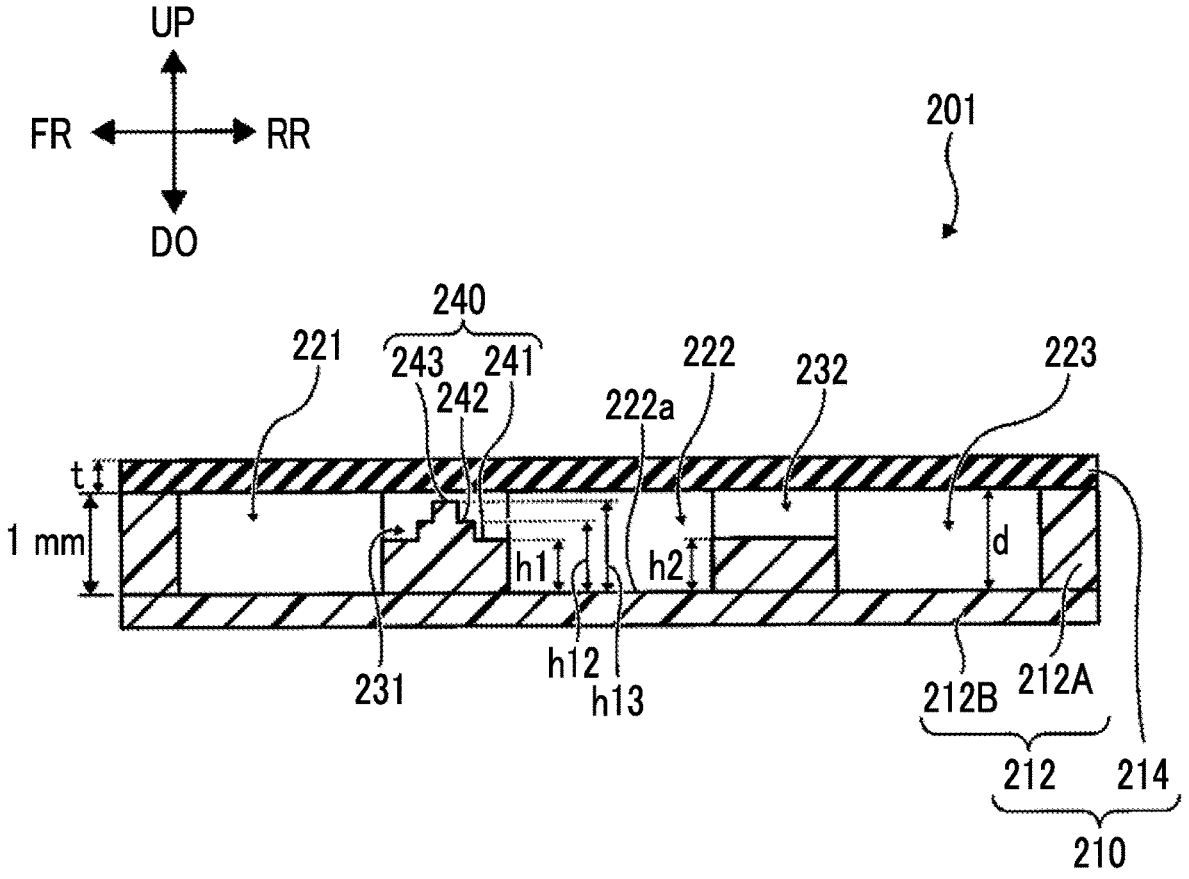
FIG. 20 is a cross-sectional view showing a schematic configuration of test containers of examples and comparative examples.
Figure 21:
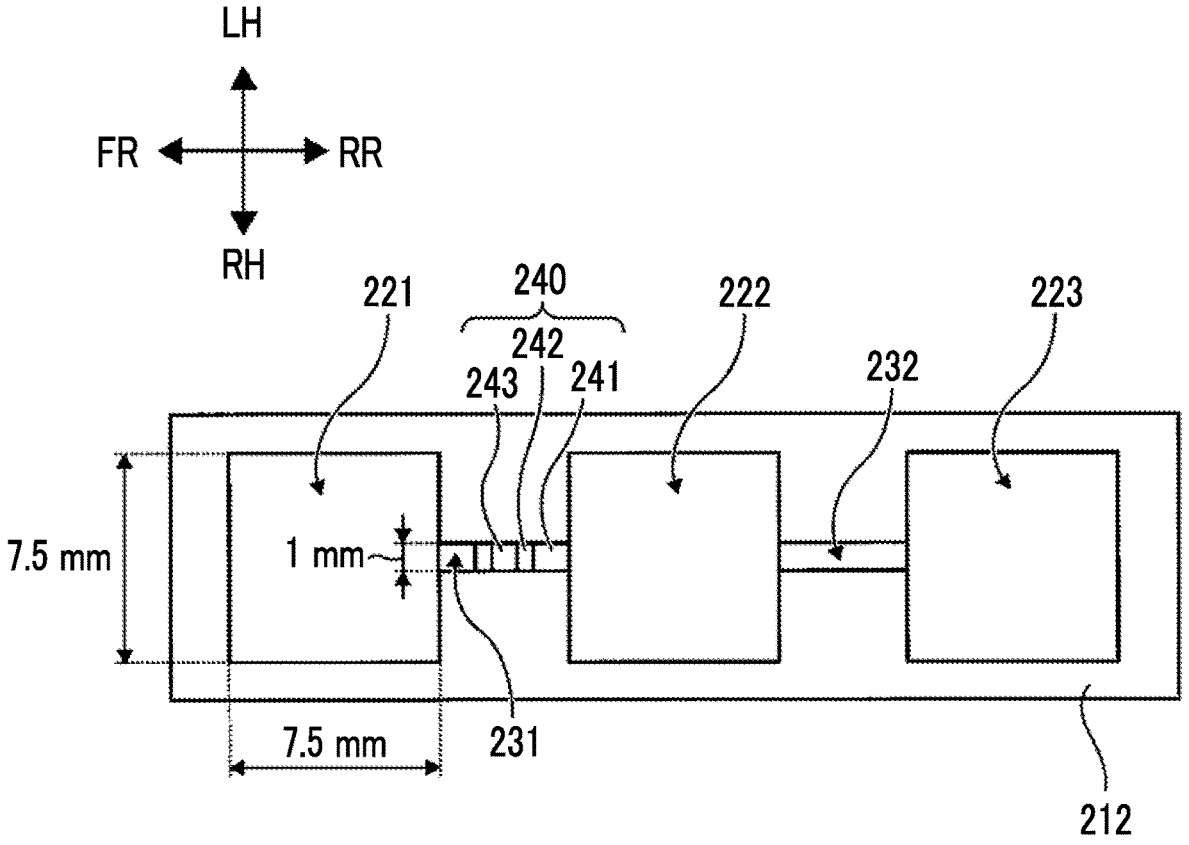
FIG. 21 is a plan view showing a schematic configuration of test containers of examples and comparative examples.

Examples and comparative examples of containers comprising three accommodation portions and flow paths connecting those to each other were prepared and evaluated. FIG. 20 is a cross-sectional view showing a shape of a test container 201 of the examples and the comparative examples. FIG. 21 is a plan view of a main body portion 212 of the test container 201 of the example and the comparative example. In each example, the container 201 comprises a first accommodation portion 221, a second accommodation portion 222, a third accommodation portion 223, a first flow path 231 connecting the first accommodation portion 221 and the second accommodation portion 222 to each other at an upper end, and a second flow path 232 connecting the second accommodation portion 222 and the third accommodation portion 223 to each other at an upper end. The three accommodation portions 221, 222, and 223 had the same shape, and had a length L of 7.5 mm, a width W of 7.5 mm, and a depth d of 1 mm. A width of the first flow path 231 and the second flow path 232 was 1 mm. The structure of the first flow path 231 and the second flow path 232 is different for each example.

Example 1

The test container of Example 1 was configured to comprise the liquid return prevention structure 1. In other words, the height h1 of the first flow path from the inner bottom surface of the second accommodation portion was set to be greater than the height h2 of the second flow path from the inner bottom surface of the second accommodation portion. h1 was set to 0.6 mm and h2 was set to 0.5 mm.

The test container 201 comprised a container main body 210, and the container main body 210 was formed of a main body portion 212 and an upper lid member 214. The main body portion 212 has an opening in a portion forming each of the first accommodation portion 221, the second accommodation portion 222, the third accommodation portion 223, the first flow path 231, and the second flow path 232, and was formed of a main body portion 212A forming side wall surfaces of the first ac 221, the second ac 222, and the third accommodation portion 223 and side wall surfaces and inner bottom surfaces of the first flow path 231 and the second flow path 232, and a bottom surface member 212B forming inner bottom surfaces of the first accommodation portion 221, the second accommodation portion 222, and the third accommodation portion 223.

Polycarbonate (PC) was used as a material of the main body portion 212. Specifically, the main body portion 212A was injection-molded using IUPILON EB-3001R manufactured by Mitsubishi Engineering Plastics Co., Ltd. As the bottom surface member 212B, Technoloy C000 (thickness of 100 μm) manufactured by Sumika Acrylic Sales Co., Ltd. was used. In addition, as the upper lid member 214, a silicone film GFSX6000 (thickness of 300 μm) manufactured by Tomita Mateqs Co., Ltd. was used.

The bottom surface member 212B was roller-bonded to the bottom surface of the main body portion 212A using an adhesive #9969 manufactured by 3M Japan Co., Ltd., and the upper lid member 214 was roller-bonded to the upper surface of the main body portion 212A using a silicone adhesive NSD-50 manufactured by Nipper Co., Ltd. to obtain a test container of Example 1.

Example 2

A test container of Example 2 was manufactured by the same method as the test container of Example 1, except that the height h1 of the first flow path was set as 0.7 mm.

Example 3

A test container of Example 3 was manufactured by the same method as the test container of Example 1, except that the height h1 of the first flow path was set as 0.8 mm.

Example 4

A test container of Example 4 was configured to comprise the liquid return prevention structure 2. In other words, the water contact angle of the inner surface of the first flow path was set to be greater than the water contact angle of the inner surface of the second flow path.

The test container of Example 4 was obtained in the same manner as in Example 1, except that the height h1 of the first flow path was set as 0.5 mm, the height h2 of the second flow path was the same, and the inner surface of the first flow path was subjected to the hydrophobic treatment. As the hydrophobic treatment of this example, Fluoro Technology Co., Ltd. (FS-1610) was applied with a brush and then dried at 70° C. for 1 minute (written as "fluorine" in Table 1).

Example 5

A test container of Example 5 comprised the same container main body as in the test container of Example 4, but the configuration of the hydrophobic surface was different. The test container of Example 5 was manufactured in the same manner as in Example 4, except that the method of hydrophobic treatment was changed. The hydrophobic treatment of this example was performed as follows. A resin composition containing hydrophobic colloidal silica was applied to the inner surface of the flow path 231 with a brush and then dried at 100° C. for 1 minute. Next, the resin composition was cured by irradiating it with light of a metal halide lamp (MAL625NAL manufactured by GS Yuasa International Ltd.) having an exposure intensity of 300 mJ/cm$^2$ in a low oxygen atmosphere having an oxygen concentration of 1,000 ppm or less, and a water-repellent resin layer was formed on the inner surface of the first flow path 231 (written as a "hydrophobic silica" in the table below).

The resin composition containing hydrophobic colloidal silica was obtained by mixing the following components.

Resin Composition

1-Methoxy-2-propanol (manufactured by FUJIFILM Wako Pure Chemical Corporation): 6.24 g A-DPH (Shin Nakamura Chemical Co., Ltd., 1-methoxy-2-propanol 10% diluted solution): 0.70 g Fluorine-based surfactant (MEGAFACE F-780F manufactured by DIC, MEK 2% diluted solution): 0.24 g Hydrophobic silica dispersion liquid: 2.61 g IRGACURE 127 (manufactured by BASF Japan Ltd., 1-methoxy-2-propanol diluted 2%): 0.21 g The hydrophobic silica dispersion liquid contained in the resin composition described above was prepared by the following procedure.

A hydrophobic silica dispersion liquid was obtained by mixing trimethylsilyl group-modified silica and 1-methoxy-2-propanol, and treating the mixture for 10 minutes while cooling with ice water using an ultrasonic homogenizer Sonifier 450 manufactured by Nippon Emerson Co., Ltd.

Here, the components of the hydrophobic silica dispersion liquid were as follows.

Components of Hydrophobic Silica Dispersion Liquid

Trimethylsilyl group-modified silica (AEROSIL RX200 (fumed silica manufactured by Nippon Aerosil Co., Ltd.)): 1 g 1-Methoxy-2-propanol (manufactured by FUJIFILM Wako Pure Chemical Corporation): 19 g Example 6

A test container of Example 6 comprises the same container main body as the test container of Example 4, but does not comprise the hydrophobic surface on the inner surface of the first flow path, and comprises a hydrophilic surface on the inner surface of the second flow path. In Example 4, instead of performing the hydrophobic treatment on the inner surface of the first flow path, the hydrophilic treatment was performed on the inner surface of the second flow path, so as to obtain the test container of Example 6 in which the water contact angle of the inner surface of the first flow path is greater than the water contact angle of the inner surface of the second flow path. As the hydrophilic treatment of this example, the corona treatment was performed on the inner surface of the second flow path under the condition of 2,000 J/m$^2$.

Example 7

A test container of Example 7 comprised the same container main body as the test container of Example 6, but the configuration of the hydrophilic surface was different. A test container of Example 7 was obtained in the same manner as in Example 6, except that the hydrophilic treatment method in Example 6 was changed. In the hydrophilic treatment of this example, the hydrophilic film was placed only on portions corresponding to the upper wall surface and the inner bottom surface of the first flow path 231. As the hydrophilic film, a hydrophilic treatment film #9984 manufactured by 3M Japan Co., Ltd. was used.

Example 8

A test container of Example 8 was configured to comprise the liquid return prevention structure 3. In other words, the test container comprised a structure of the stepped portion 240 including two or more steps from the inner bottom surface 222*a* of the second accommodation portion 222, which is configured on the second accommodation portion 222 side of the first flow path 231. Here, the stepped portion 240 has two steps 241 and 242.

A test container of Example 8 was obtained in the same manner as in Example 1, except that the stepped portion 240 was provided in a portion adjacent to the second accommodation portion 222 of the first flow path 231. The height h1 of the first step 241 (referred to as a "step 1" in Table 1) from the inner bottom surface 222*a* of the second accommodation portion 222 was set as 0.25 mm, and the height h2 of the second step 242 (referred to as a "step 2" in Table 1) from the inner bottom surface 222*a* of the second accommodation portion 222 was set as 0.5 mm.

Example 9

A test container of Example 9 was manufactured by the same method as in Example 8, except that the height h12 of the second step 242 of the stepped portion 240 from the inner bottom surface 222*a* of the second accommodation portion 222 was set as 0.65 mm and the stepped portion 240 was provided.

Example 10

A test container of Example 10 was configured to provide a third step 243 on the stepped portion 240 to comprise three steps 241, 242, and 243. The test container was manufactured by the same manner by setting the heights h1 and h12 of the first step 241 and the second step 242 to be the same as in Example 9 except that a height h13 of the third step 243 (referred to as a "step 3" in Table 1) from the inner bottom surface 222*a* of the second accommodation portion 222 was set as 0.8 mm.

Example 11

A test container of Example 11 was configured to comprise the liquid return prevention structure 1 and the liquid return prevention structure 2. In other words, the height h1 of the first flow path 231 from the inner bottom surface 222*a* of the second accommodation portion 222 was set to be greater than the height h2 of the second flow path 232 from the inner bottom surface 222*a* of the second accommodation portion 222, and the water contact angle of the inner surface of the first flow path 231 was set to be greater than the water contact angle of the inner surface of the second flow path 232.

The test container of Example 11 was manufactured by the same method as in Example 1, except that the inner surface of the first flow path was subjected to the same hydrophobic treatment as in Example 4.

Example 12

A test container of Example 12 was configured to comprise the liquid return prevention structure 1 and the liquid return prevention structure 3. In other words, the height h1 of the first flow path 231 from the inner bottom surface 222*a* of the second accommodation portion 222 was set to be greater than the height h12 of the second flow path 232 from the inner bottom surface 222*a* of the second accommodation portion 222, and the test container comprised a structure of the stepped portion 240 of two or more steps from the inner bottom surface 222*a* of the second accommodation portion 222 in a region of the first flow path 231 adjacent to the second accommodation portion 222.

A test container of Example 12 was manufactured by the same method as in Example 8, except that the height h1 of the first step 241 from the inner bottom surface 222*a* of the second accommodation portion 222 was 0.6 mm and the height h12 of the second step 242 from the inner bottom surface 222*a* of the second accommodation portion 222 was set as 0.7 mm.

Example 13

A test container of Example 13 was configured to comprise the liquid return prevention structure 2 and the liquid return prevention structure 3. In other words, the water contact angle of the inner surface of the first flow path 231 was set to be greater than the water contact angle of the inner surface of the second flow path 232, and the test container comprised a structure of the stepped portion 240 including two or more steps from the inner bottom surface 222*a* of the second accommodation portion 222 configured on the second accommodation portion 222 of the first flow path 231.

In the test container of Example 13, a container of Example 13 was obtained as in Example 8, except that the height h1 of the first step 241 from the inner bottom surface 222*a* of the second accommodation portion 222 was set as 0.5 mm, the height h2 of the second step 242 from the inner bottom surface 222*a* of the second accommodation portion 222 was set as 0.8 mm, and the same hydrophobic treatment as in Example 4 was performed on the inner surface of the first flow path 231.

Example 14

A test container of Example 14 was configured to comprise the liquid return prevention structure 1, the liquid return prevention structure 2, and the liquid return prevention structure 3. The height h1 of the first flow path 231 from the inner bottom surface 222*a* of the second accommodation portion 222 was set to be greater than the height h2 of the second flow path 232 from the inner bottom surface 222*a* of the second accommodation portion 222, the water contact angle of the inner surface of the first flow path 231 was set to be greater than the water contact angle of the inner surface of the second flow path 232, and the test container comprised the structure of the stepped portion 240 including two or more steps from the inner bottom surface 222*a* of the second accommodation portion 222, configured on the second accommodation portion 222 side of the first flow path 231.

In Example 8, a container of Example 14 was obtained by setting the height h1 of the first step 241 from the inner bottom surface 222*a* of the second accommodation portion 222 as 0.6 mm, the height h2 of the second step 242 from the inner bottom surface 222*a* of the second accommodation portion 222 as 0.8 mm, and performing the same hydrophobic treatment as in Example 4 on the inner surface of the first flow path 231.

Example 15

A container of Example 15 had the same configuration as in Example 14, except that polypropylene (PP) was used as the material of the main body portion 212.

In this example, the main body portion 212A was injection-molded using WINTEC WMGO3UX manufactured by Japan Polypro Corporation. As the bottom surface member 212B, Trefan B060-2500 (thickness of 60 μm) manufactured by Toray Industries, Inc. was used. In addition, in the same manner as in Example 1, a silicone film GFSX6000 (thickness of 300 μm) manufactured by Tomita Mateqs Co., Ltd. was used for the upper lid member 214.

Example 16

A container of Example 16 had the same configuration as in Example 14, except that a polymethyl methacrylate resin (PMMA) was used as the material of the main body portion 212.

In this example, the main body portion 212A was injection-molded using Acrypet VH001 manufactured by Mitsubishi Chemical Corporation, and Technoloy 5001 manufactured by Sumika Acrylic Sales Co., Ltd. (thickness 125 μm) was used as the bottom surface member 212B.

Example 17

A container of Example 17 had the same configuration as in Example 14, except that COP was used as the material of the main body portion 212.

In this example, the main body portion 212A was injection-molded using ARTON F4520 manufactured by JSR Corporation, and a film having a thickness of 50 μm obtained by forming a film of ARTON R5000 manufactured by JSR Corporation was used as the bottom surface member 212B.

Comparative Example 1

A test container of Comparative Example 1 did not comprise a liquid return prevention structure.

In the test container of Comparative Example 1, the height h1 of the first flow path 231 from the inner bottom surface 222*a* of the second accommodation portion 222 was set as 0.5 mm, and the height h2 of the second flow path 232 from the inner bottom surface 222*a* of the second accommodation portion 222 was set as the same as in Example 1. The test container of Comparative Example 1 was obtained in the same manner as in Example 1 except for the above point.

With respect to the containers of Examples 1 to 17 and Comparative Example 1 obtained as described above, the water contact angles of the inner surfaces of the second accommodation portion and the first flow path were measured.

Water Contact Angle

A fully automatic contact angle meter (model number: DM-701, Kyowa Interface Science Co., Ltd.) was used to measure the water contact angle. Under the condition of an atmosphere temperature of 25° C., 1 μL of pure water was added dropwise to the inner surfaces of the first flow path and the second flow path, a contact angle was measured by the θ/2 method, and an arithmetic mean value of the values obtained by performing the measurement five times was used as a value of the contact angle. The water contact angles of the first flow path and the second flow path of the container of each example and the difference therebetween (water contact angle of the first flow path—water contact angle of the second flow path) are shown in Table 1.

The liquid feeding properties of the containers of Examples 1 to 17 and Comparative Example 1 were evaluated by the following method.

Evaluation of Liquid Feeding Properties

After filling the second accommodation portion 222 with water, the vicinity of the center of the portion forming the upper wall surface of the second accommodation portion 222 was pushed in by a ball plunger as a pressing portion. Accordingly, a weight of the liquid fed to the third accommodation portion 223 and a weight of the liquid flowed back to the first accommodation portion 221 were measured, and a ratio thereof was calculated as a liquid return rate.

That is, Liquid return rate=(Weight of liquid returned to the first accommodation portion [mg])/(Weight of liquid fed to the third accommodation portion [mg]).

The liquid return rate was evaluated according to the following criteria. For practical use, liquid return rate at least at level E is required. In addition, practically, liquid return rate at level D or less is preferable, liquid return rate at level C or less is more preferable, and liquid return rate at level B or less is further preferable.

A: less than 5%
B: 5% or more and less than 10%
C: 10% or more and less than 15%
D: 15% or more and less than 20%
E: 20% or more and less than 25%
F: 30% or more Table 1 collectively shows a structure, measurement, and evaluation results of the test container of each example.

TABLE 1

| | Liquid return prevention structure | | | First flow path | | | |
|---|---|---|---|---|---|---|---|
| | Structure 1 h1 > h2 | Structure 2 R1 > R2 | Structure 3 Stepped portion | Height h1 of step 1 (mm) | Height h12 of step 2 (mm) | Height h13 of step 3 (mm) | Surface treatment |
| Example 1 | Observed | — | — | 0.6 | — | — | — |
| Example 2 | Observed | — | — | 0.7 | — | — | — |
| Example 3 | Observed | — | — | 0.8 | — | — | — |
| Example 4 | — | Observed | — | 0.5 | — | — | Fluorine |
| Example 5 | — | Observed | — | 0.5 | — | — | Hydrophobic silica |
| Example 6 | — | Observed | — | 0.5 | — | — | — |
| Example 7 | — | Observed | — | 0.5 | — | — | — |
| Example 8 | — | — | Observed | 0.25 | 0.5 | — | — |
| Example 9 | — | — | Observed | 0.25 | 0.65 | — | — |
| Example 10 | — | — | Observed | 0.25 | 0.65 | 0.8 | — |

TABLE 1-continued

| | | | | | | | |
|---|---|---|---|---|---|---|---|
| Example 11 | Observed | Observed | — | 0.6 | — | — | Fluorine |
| Example 12 | Observed | — | Observed | 0.6 | 0.7 | — | — |
| Example 13 | — | Observed | Observed | 0.5 | 0.8 | — | Fluorine |
| Example 14 | Observed | Observed | Observed | 0.6 | 0.8 | — | Fluorine |
| Example 15 | Observed | Observed | Observed | 0.6 | 0.8 | — | Fluorine |
| Example 16 | Observed | Observed | Observed | 0.6 | 0.8 | — | Fluorine |
| Example 17 | Observed | Observed | Observed | 0.6 | 0.8 | — | Fluorine |
| Comparative Example 1 | — | — | — | 0.5 | — | — | — |

| | First flow path | Second flow path | | | Water | |
|---|---|---|---|---|---|---|
| | Water contact angle R1 (°) | Height h2 (mm) | Surface treatment | Water contact angle R2 (°) | contact angle difference R1-R2 (°) | Evaluation Liquid feeding properties |
| Example 1 | 87 | 0.5 | — | 87 | 0 | E |
| Example 2 | 87 | 0.5 | — | 87 | 0 | D |
| Example 3 | 87 | 0.5 | — | 87 | 0 | C |
| Example 4 | 105 | 0.5 | — | 87 | 18 | E |
| Example 5 | 151 | 0.5 | — | 87 | 64 | C |
| Example 6 | 87 | 0.5 | Corona treatment | 45 | 42 | D |
| Example 7 | 87 | 0.5 | Hydrophilic sheet | 18 | 69 | C |
| Example 8 | 87 | 0.5 | — | 87 | 0 | E |
| Example 9 | 87 | 0.5 | — | 87 | 0 | D |
| Example 10 | 87 | 0.5 | — | 87 | 0 | C |
| Example 11 | 105 | 0.5 | — | 87 | 18 | C |
| Example 12 | 87 | 0.5 | — | 87 | 0 | C |
| Example 13 | 105 | 0.5 | — | 87 | 18 | B |
| Example 14 | 105 | 0.5 | — | 87 | 18 | A |
| Example 15 | 105 | 0.5 | — | 97 | 8 | A |
| Example 16 | 105 | 0.5 | — | 95 | 10 | A |
| Example 17 | 105 | 0.5 | — | 92 | 13 | A |
| Comparative Example 1 | 87 | 0.5 | — | 87 | 0 | F |

As shown in Table 1, in all of Examples 1 to 17 comprising the liquid return prevention structure, it was possible to improve the liquid feeding properties, compared to Comparative Example 1 not comprising the liquid return prevention structure.

In each of Examples 1 to 3, the liquid return prevention structure 1 was comprised, and as the difference (h1-h2) between the height h1 of the first flow path and the height h2 of the second flow path was great, the liquid feeding properties to the third accommodation portion were improved.

In each of Examples 4 to 7, the liquid return prevention structure 2 was comprised, and as the difference (R1-R2) between the water contact angle R1 on the inner surface of the first flow path and the water contact angle on the inner surface of the second flow path was great, the liquid feeding properties to the third accommodation portion were improved. The difference in water contact angle difference is preferably 40° or more, and more preferably 60° or more.

In each of Examples 8 to 10, the liquid return prevention structure 3 is comprised. Each of Examples 8 and 9, the stepped portion of two steps is comprised, and the height of a step 1 may be the same, but the height of a step 2 may be different. As a second height was great, the liquid feeding properties to the third accommodation portion was increased. In Example 10, a stepped portion of three steps is comprised, and the height of the stepped portion of the step 1 and the step 2 is the same as in Example 9. It is considered that as the number of steps of the stepped portion is great, the liquid feeding properties to the third accommodation portion are improved.

In Examples 11 to 14, any two or all of the liquid return prevention structures 1 to 3 are comprised in combination. By combining the liquid return prevention structures, the liquid feeding properties to the third accommodation portion were improved, compared to a case where only one structure is comprised. In particular, in Example 13 in which the liquid return prevention structures 2 and 3 were combined, the liquid feeding properties were higher than those in Examples 11 and 12. In addition, among Examples 11 to 14, in Example 14 comprising all of the liquid return prevention structures 1, 2 and 3, the liquid feeding properties were the highest and a preferable result was obtained.

In Examples 14 to 17, the same shape comprising all of the liquid return prevention structures 1 to 3 is provided, but the materials of the containers are different. Even in a case where the materials of the containers were different, high liquid feeding properties were obtained in all examples.

In a case where a plurality of liquid return prevention structures are comprised in combination as in Example 11 and Examples 13 to 17, the sufficient effect was obtained, even in a case where the difference between the water contact angle R1 of the first flow path and the water contact angle R2 of the second flow path is in a range of 5° to 20°.

EXPLANATION OF REFERENCES

1, 1A, 2, 3, 3A, 4, 5, 6: Test container

10, 10A, 10B, 10C, 10D, 10E, 10F, 10G: Container main body

12, 12A, 12B, 12C, 12D, 12E, 12F, 12G: Main body portion

14: Upper lid member

14A: Portion
21: First accommodation portion
21*b*: Upper wall surface of first accommodation portion
22: Second accommodation portion
22*a*: Inner bottom surface of second accommodation portion
22*b*: Upper wall surface of second accommodation portion
22*c*: Inner side surface of second accommodation portion
23: Third accommodation portion
31: First flow path
31*a*: Inner bottom surface of first flow path
32: Second flow path
32*a*: Inner bottom surface of second flow path
33, 43: Corner
34: Hydrophobic surface
40: Stepped portion
41, 42: Step
50: Pressing machine
52: Plunger
54: Cylinder
60: Liquid feeding device
100: nucleic acid extraction test device
101: test container
102: Transportation unit
106: Dispenser
107: Magnetic field generation and movement unit
108: Temperature control unit
110: Container main body
112: Main body portion
114: Upper lid member
114A: Portion
120: Magnetism collecting chamber (accommodation portion)
121: Cleaning chamber (first accommodation portion)
122: PCR chamber (second accommodation portion)
122*a*: Inner bottom surface of PCR chamber
123: Detection chamber (third accommodation portion)
125: Chromatographic carrier accommodation portion
128: Chromatographic carrier
130, 131, 132, 135, 145: flow path
150: specimen solution
151: Cleaning solution
152: PCR solution
153: Development solution
160-163: Syringe
170: Movement mechanism
201: Test container
210: Container main body
212: Main body portion
212A: Main body portion
212B: Bottom surface member
214: Upper lid member
221: First accommodation portion
222: Second accommodation portion
223: Third accommodation portion
231: First flow path
232: Second flow path
240: Stepped portion
241, 242, 243: step
M: Magnet
P: Magnetic particles

What is claimed is:

1. A test container, comprising:

a container main body including a first accommodation portion, a second accommodation portion, and a third accommodation portion each accommodating a liquid and internally provided, a first flow path connecting the first accommodation portion and the second accommodation portion to each other at respective upper end positions thereof and internally provided, and a second flow path connecting the second accommodation portion and the third accommodation portion to each other at respective upper end positions thereof and internally provided, in which at least a portion forming an upper wall surface of the second accommodation portion has flexibility to be deformable inwards of the second accommodation portion; and a liquid return prevention structure configured to prevent a backflow of the liquid to the first accommodation portion, when the liquid accommodated in the second accommodation portion is fed to the third accommodation portion via the second flow path due to deformation of the portion forming the upper wall surface of the second accommodation portion inwards of the second accommodation portion.

2. The test container according to claim 1, wherein the container main body comprises a main body portion in which a portion forming each of the first accommodation portion, the first flow path, the second accommodation portion, the second flow path, and the third accommodation portion is open, and an upper lid member including the portion forming the upper wall surface of the second accommodation portion, and the first accommodation portion, the first flow path, the second accommodation portion, the second flow path, and the third accommodation portion are internally formed by covering the opening of the main body portion with the upper lid member.

3. The test container according to claim 1, wherein the liquid return prevention structure has a structure in which a height from an inner bottom surface of the second accommodation portion to an inner bottom surface of the first flow path is higher than a height from the inner bottom surface of the second accommodation portion to an inner bottom surface of the second flow path.

4. The test container according to claim 2, wherein the liquid return prevention structure has a structure in which a height from an inner bottom surface of the second accommodation portion to an inner bottom surface of the first flow path is higher than a height from the inner bottom surface of the second accommodation portion to an inner bottom surface of the second flow path.

5. The test container according to claim 3, wherein an angle formed by the inner bottom surface of the first flow path and an inner side surface of the second accommodation portion in a level difference portion between the inner bottom surface of the first flow path and the second accommodation portion is an acute angle.

6. The test container according to claim 4, wherein an angle formed by the inner bottom surface of the first flow path and an inner side surface of the second accommodation portion in a level difference portion between the inner bottom surface of the first flow path and the second accommodation portion is an acute angle.

7. The test container according to claim 1, wherein the liquid return prevention structure has a structure of the first flow path and the second flow path in which a water contact angle of an inner surface of the first flow path is set to be greater than a water contact angle of an inner surface of the second flow path.

8. The test container according to claim 2, wherein the liquid return prevention structure has a structure of the first flow path and the second flow path in which a water contact angle of an inner surface of the first flow path is set to be greater than a water contact angle of an inner surface of the second flow path.

9. The test container according to claim 3, wherein the liquid return prevention structure has a structure of the first flow path and the second flow path in which a water contact angle of an inner surface of the first flow path is set to be greater than a water contact angle of an inner surface of the second flow path.

10. The test container according to claim 4, wherein the liquid return prevention structure has a structure of the first flow path and the second flow path in which a water contact angle of an inner surface of the first flow path is set to be greater than a water contact angle of an inner surface of the second flow path.

11. The test container according to claim 5, wherein the liquid return prevention structure has a structure of the first flow path and the second flow path in which a water contact angle of an inner surface of the first flow path is set to be greater than a water contact angle of an inner surface of the second flow path.

12. The test container according to claim 6, wherein the liquid return prevention structure has a structure of the first flow path and the second flow path in which a water contact angle of an inner surface of the first flow path is set to be greater than a water contact angle of an inner surface of the second flow path.

13. The test container according to claim 1, wherein the liquid return prevention structure has a structure of a stepped portion which is provided on the second accommodation portion side of the first flow path and which includes two or more steps from an inner bottom surface of the second accommodation portion.

14. The test container according to claim 2, wherein the liquid return prevention structure has a structure of a stepped portion which is provided on the second accommodation portion side of the first flow path and which includes two or more steps from an inner bottom surface of the second accommodation portion.

15. The test container according to claim 3, wherein the liquid return prevention structure has a structure of a stepped portion which is provided on the second accommodation portion side of the first flow path and which includes two or more steps from an inner bottom surface of the second accommodation portion.

16. The test container according to claim 4, wherein the liquid return prevention structure has a structure of a stepped portion which is provided on the second accommodation portion side of the first flow path and which includes two or more steps from an inner bottom surface of the second accommodation portion.

17. The test container according to claim 5, wherein the liquid return prevention structure has a structure of a stepped portion which is provided on the second accommodation portion side of the first flow path and which includes two or more steps from an inner bottom surface of the second accommodation portion.

18. The test container according to claim 13, wherein an angle formed by an inner bottom surface and an inner side surface forming at least one step of the stepped portion is an acute angle.

19. The test container according to claim 1, further comprising:

a chromatographic carrier for performing a nucleic acid test; and a carrier accommodation portion accommodating the chromatographic carrier.

20. The test container according to claim 1, wherein the first accommodation portion accommodates a first liquid containing magnetic particles, the first flow path allows separated magnetic particles separated from the first liquid to pass through the first flow path, and the second accommodation portion accommodates the separated magnetic particles.

* * * * *